US011608687B2

(12) United States Patent
Torres et al.

(10) Patent No.: US 11,608,687 B2
(45) Date of Patent: Mar. 21, 2023

(54) METHODS AND SYSTEMS FOR ADAPTIVE NON-CONTACT / CONTACT BORING

(71) Applicant: ArcByt, Inc., San Francisco, CA (US)

(72) Inventors: Shivani Torres, San Francisco, CA (US); Thomas Egan, San Francisco, CA (US); Barzin Moridian, San Francisco, CA (US)

(73) Assignee: ArcByt, Inc., San Francisco, CA (US)

( * ) Notice: Subject to any disclaimer, the term of this patent is extended or adjusted under 35 U.S.C. 154(b) by 0 days.

(21) Appl. No.: 17/804,805

(22) Filed: May 31, 2022

(65) Prior Publication Data

US 2022/0389763 A1 Dec. 8, 2022

Related U.S. Application Data

(60) Provisional application No. 63/197,825, filed on Jun. 7, 2021, provisional application No. 63/195,122, filed on May 31, 2021.

(51) Int. Cl.

| | |
|---|---|
| ***E21B 7/15*** | (2006.01) |
| ***E21B 7/14*** | (2006.01) |
| ***E21B 44/02*** | (2006.01) |

(52) U.S. Cl.

CPC ..... *E21B 7/15* (2013.01); *E21B 7/14* (2013.01); *E21B 44/02* (2013.01); *E21B 2200/22* (2020.05)

(58) Field of Classification Search

CPC ..... E21B 7/15; E21B 4/16; E21B 7/18; E21B 10/00

See application file for complete search history.

(56) References Cited

U.S. PATENT DOCUMENTS

| | | | | |
|---|---|---|---|---|
| 4,790,394 | A * | 12/1988 | Dickinson, III | E21B 7/18 175/73 |
| 10,480,249 | B2 * | 11/2019 | Samuel | E21B 10/567 |
| 10,584,585 | B2 | 3/2020 | Helming | |
| 2005/0173153 | A1 | 8/2005 | Alft et al. | |
| 2007/0125580 | A1 | 6/2007 | Hall et al. | |
| 2011/0278270 | A1 * | 11/2011 | Braga | B28D 1/146 219/121.7 |
| 2016/0160618 | A1 | 6/2016 | Batarseh et al. | |
| 2017/0159370 | A1 | 6/2017 | Evans et al. | |
| 2022/0056800 | A1 | 2/2022 | Wright et al. | |
| 2022/0082017 | A1 | 3/2022 | Abrams et al. | |

FOREIGN PATENT DOCUMENTS

WO 2019217813 A1 11/2019

OTHER PUBLICATIONS

International Application No. PCT/US2022/072655, Search Report and Written Opinion dated Sep. 19, 2022.

* cited by examiner

*Primary Examiner* — Jonathan Malikasim
(74) *Attorney, Agent, or Firm* — Polygon IP, LLP

(57) ABSTRACT

The systems and techniques described herein may allow for optimized boring through a variety of geologies. A plurality of different boring techniques may be utilized for boring through a geological formation, in order to suit the characteristics of various portions of the geological formation. The systems and techniques described herein includes determining geological features and adjusting operation of boring based on the geological features. In certain such embodiments, boring systems may include a bore head that includes a plurality of boring elements. Such boring elements may be contact and/or non-contact boring elements.

18 Claims, 16 Drawing Sheets

1000

METHODS AND SYSTEMS FOR ADAPTIVE NON-CONTACT / CONTACT BORING

CROSS-REFERENCE TO RELATED APPLICATIONS

This application claims the benefit under 35 U.S.C. § 119(e) of U.S. Provisional Patent Application No. 63/195,122, filed on 2021 May 31 and U.S. Provisional Patent Application No. 63/197,825 filed on 2021 Jun. 7, both of which are incorporated herein by reference in their entirety for all purposes.

TECHNICAL FIELD

This invention relates generally to the field of subterranean excavation and more specifically to new and useful methods for underground boring, as well as trenching, with new and useful non-contact boring systems in the field of underground boring and trenching.

BACKGROUND

Traditional boring techniques are generally performant under and optimized for specific ground conditions. Conventional techniques engage the ground through contact, and thus are limited by thrust and torque. By extension, conventional techniques are limited in face monitoring, steering, and localized control of the cutting action at the face. Most importantly, traditional boring and trenchless techniques struggle with changing geological conditions as well as other conditions.

SUMMARY

Described herein are new methods and systems for adaptive boring utilizing non-contact boring mechanisms. In a certain embodiment, a system may be disclosed. The system may include a bore head including a non-contact boring mechanism, a first sensor, configured to measure a first parameter associated with operations of the non-contact boring mechanism, and a controller, communicatively coupled to the first sensor and configured to perform operations including causing the non-contact boring mechanism to operate in a first manner, receiving first data from the first sensor, determining a first boring parameter from the first data; and causing, based on the determined first boring parameter, the non-contact boring mechanism to operate in a second manner.

In another embodiment, a method may be disclosed. The method may include preparing first multi-head boring training data, the first multi-head boring training data including a plurality of boring scenarios for boring with a bore head including a non-contact boring mechanism and a contact boring mechanism, each boring scenario including first geological composition composition data for a plurality of bore sites, first non-contact boring data indicating first non-contact boring portions of the plurality of bore sites, and first contact boring data indicating first contact boring portions of the plurality of bore sites, and providing the first multi-head boring training data to a machine learning device to train the machine learning device.

DETAILED DESCRIPTION

Figure 1A:
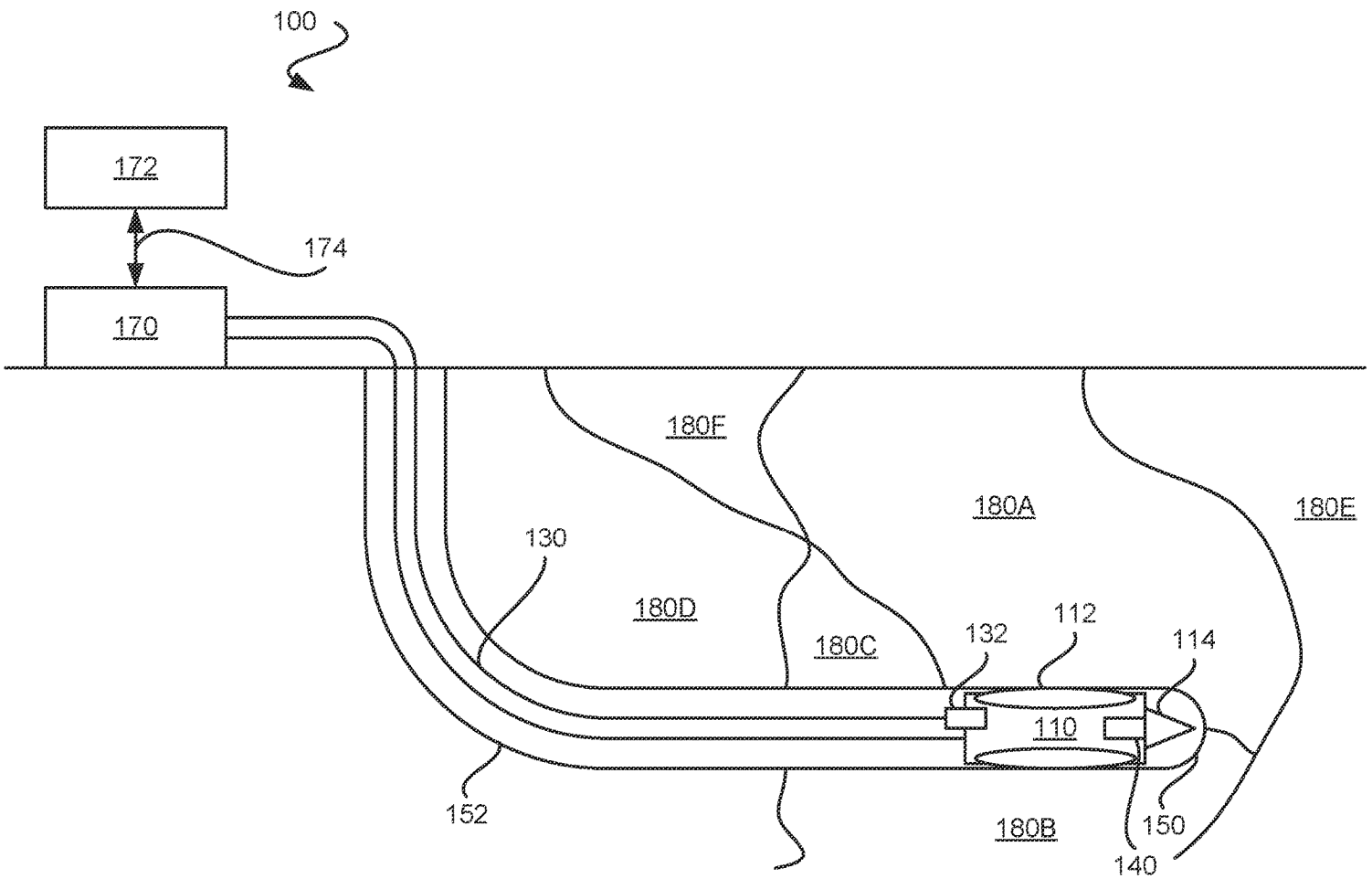
FIG. 1A illustrates a representation of an example boring situation, in accordance with certain embodiments.

In the following description, numerous specific details are outlined to provide a thorough understanding of the presented concepts. The presented concepts may be practiced without some or all of these specific details. In other instances, well-known process operations have not been described in detail to not unnecessarily obscure the described concepts. While some concepts will be described in conjunction with the specific embodiments, it will be understood that these embodiments are not intended to be limiting.

INTRODUCTION

Traditional boring techniques suffer from a variety of limitations. The non-contact boring systems and techniques described herein may allow for overcoming of these limitations. Conventional techniques typically revolve around only one boring technique. However, each individual technique may suffer limitations when encountering different geologies. The systems and techniques described herein may allow for optimized boring through a variety of geologies in a continuous manner (e.g., through the use of a plurality of different boring techniques). Non-contact boring techniques, such as the techniques described herein, are superior in addressing changing ground conditions, which traditional techniques typically struggle with.

Furthermore, conventional boring techniques are limited in face monitoring, as the bore face under conventional techniques is typically inaccessible and/or inhospitable to sensing and monitoring systems. The systems and techniques described herein allow for improved monitoring (as the systems described herein allow for space at the front of the bore head for the location of sensors to monitor the bore face). Such improved monitoring allows for boring in a large variety of geological conditions and greater local control at the bore face. Thus, these techniques allow for greater boring adaptability and quicker response to changing conditions.

The systems and techniques described herein may allow for an integrated manner of boring that allows for boring to be performed in a single pass. Traditional boring techniques may require a plurality of passes to complete due to features of a geological formation. The boring techniques described herein may allow for the sensing of parameters of boring at the bore face, from the spoil (e.g., for mineral analysis), and/or other aspects of boring.

In certain embodiments, the systems and techniques described herein includes determining geological features and adjusting operation of boring based on the geological features. In certain such embodiments, boring systems may include a bore head that includes a plurality of boring elements. Such boring elements may be contact and/or non-contact boring elements. Non-contact boring may include boring techniques that utilize jet engines, plasma, acetylene, water jet, and/or other such techniques that utilize heat, mass flow, and/or a combination thereof to perform boring. Contact boring may include conventional boring techniques such as auger boring, percussive boring, slurry boring, and/or other such techniques that may utilize physical contact between a boring element and/or a boring medium.

For the purposes of this disclosure, references to various permutations of "boring" may refer 1) to "boring" for investigation, assessment, and/or installation of various installations, 2) to "drilling" for extraction of materials, 3) to "trenching," and/or 4) to any other technique that includes the excavation, removal of, or disturbance of subterranean materials.

Boring System

FIG. 1A illustrates a representation of an example boring situation, in accordance with certain embodiments. FIG. 1A illustrates system 100 that may be used for various boring scenarios. System 100 may include chassis 110 with drivetrain 112 and non-contact boring element 114. Chassis 110 and the elements thereof may be coupled to onsite facility 170 via umbilical cord 130. Onsite facility 170 may, in certain embodiments, be optionally communicatively coupled to offsite controller 172 via communications medium 174, which may be wired and/or wireless communications medium configured to provide and receive data, such as Internet, satellite communications, cable communications, and/or other types of communications techniques.

Chassis 110 may be any type of chassis where elements of a boring system may be coupled to thereof (e.g., non-contact boring element 114 may be coupled to chassis 110). Thus, chassis 110 may, in certain embodiments, be a space frame, sled, and/or other such chassis. Drivetrain 112 may be coupled to chassis 110 and may include a set of wheels or tracks driven by an electric, hydraulic, and/or pneumatic motor. Drivetrain 112 may be configured to move chassis 110, and the elements coupled thereof, downhole to position chassis 110.

Non-contact boring element 114 may be coupled to chassis 110 and may be configured to excavate portions of a geological formation through a non-contact technique, such as through the use of heat, mass flow, a combination of the two, and/or a similar non-contact technique. Non-contact boring element 114 may include one or more of a cutterhead, a plasma torch, a jet engine exhaust, jet engine exhaust plus afterburner, a flame jet, a pneumatic drill, a water jet, a steam or gas jet, an abrasive material jet, a sonic wave generator, an electromagnetic or particle beam, and/or any similar non-contact technique.

Figure 2:
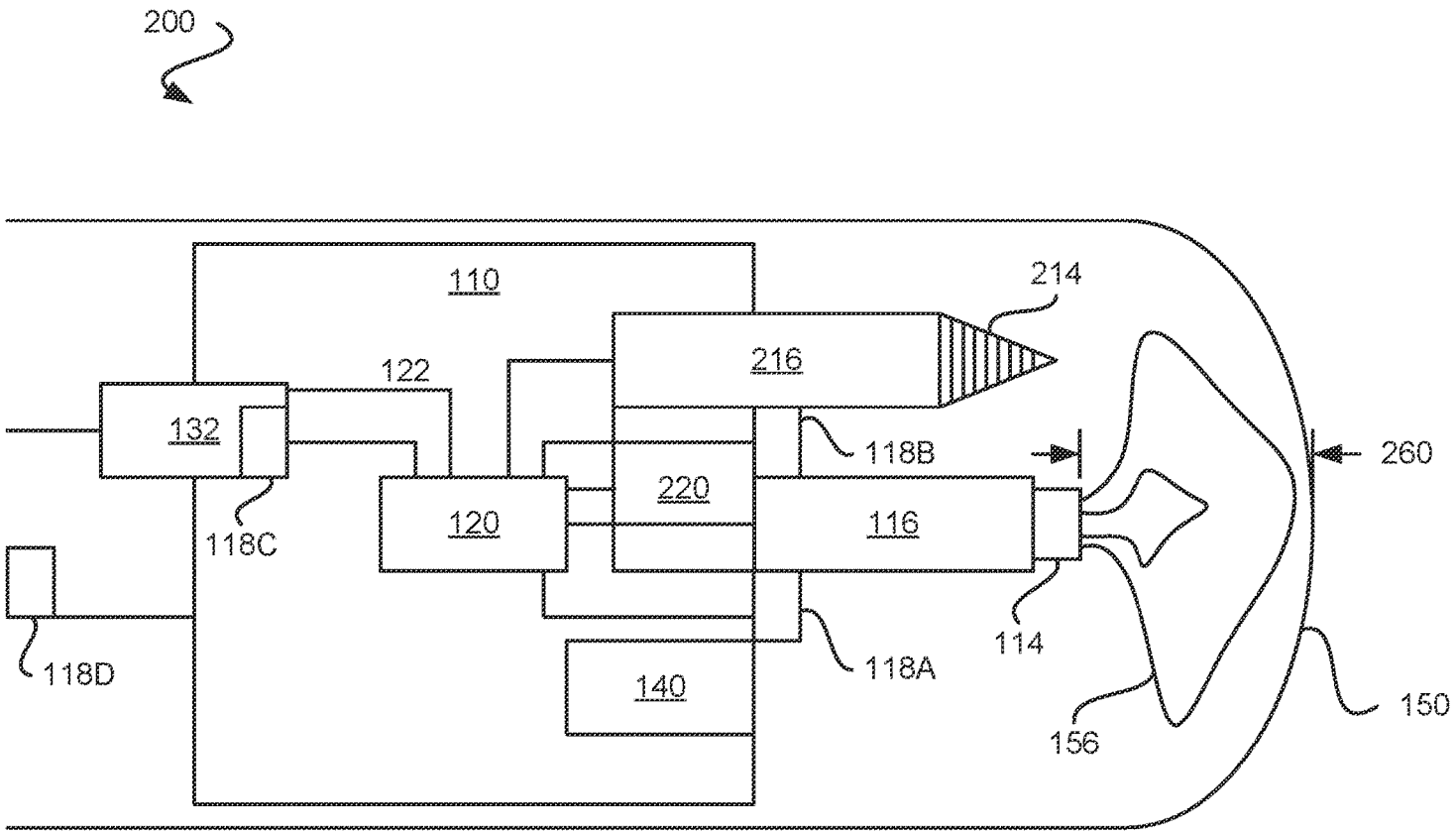
FIG. 2 illustrates a side view of an example bore head, in accordance with certain embodiments.

In various embodiments, system 100 may further include contact boring element 214 (not shown in FIG. 1A, but shown in FIG. 2). Contact boring element 214 may be configured to excavate portions of a geological formation through physical contact between a tool and/or fluid. Contact boring element 214 may include one or more of a hammer drill, a rotary drill, a displacement bore, a trencher, a pipe jack, a pipe ram, a pneumatic drill, a horizontal auger bore, a guided auger bore, a tunnel boring machine, a slurry drill (e.g., microtunnel boring machine, shielded and/or unshielded), a combination of rotationally or linearly actuated drills and hammers, and/or a similar contact boring technique. Variously, system 100 may be configured to utilize non-contact and/or contact drilling techniques that are suitable for determined geological conditions and the boring rigs/boring heads described herein may include a plurality of boring elements and may be configured to allow for switching between the boring elements.

System 100 may further include sensors (as described herein), a spoil evacuator 132 configured to draw or force waste (e.g., gas, spall, tailing, and/or other waste) from between the boring element(s) and bore face 150. Spoil evacuator 132 may be configured to remove such waste to a region out of borehole 152 and/or away from bore face 150. A filtration or collection element 140 may, additionally or alternatively, be configured to collect spoil at bore face 150 (e.g., debris or waste created by the excavation of borehole 152 or bore face 150). Removal of such waste or spoil may be via umbilical cord 130, which may be configured to receive such materials from spoil evacuator 132 and/or filtration or collection element 140. Filtration or collection element 140 may collect spoil and filter out appropriate size spoil for analysis (e.g., mineralogy analysis at, for example, onsite facility 170. Spoil collect may include solid spoil as well as liquid and/or gaseous spoil (e.g., vapors).

In various embodiments, borehole 152 may be a tunnel, trench, or other feature created by system 100. Borehole 152 may, in various embodiments, be a lined or unlined borehole. In embodiments where borehole 152 is typically unlined, the sensors of system 100 may generate a three-dimensional spatial and surface finish map of borehole 152 via data from sensors (e.g., described in FIG. 2) described herein. Such sensors may include, for example, one or more cameras, radar, lidar, and/or other such sensors. From such a map, one or more controllers of system 100 may generate an image or model and determine whether borehole 152 is suitable for use without a liner or whether a liner is needed. For example, some types of geology may yield hard and smooth bored surfaces, for which an interior liner may not be necessary. Other types of geology may yield softer or more jagged bored surfaces, for which an interior liner may be desirable. Borehole 152 may include both types of example geologies, as well as other such geologies.

Umbilical cord 130 may be configured to allow for communication between onsite facility 170 and chassis 110 and, thus, between onsite facility 170, as well as other facilities and controllers associated with boring, and the boring elements and/or other elements coupled to chassis 110. Such communications may include data communications (e.g., for communications of sensor data and/or for communications of instructions) as well as material communications (e.g., of waste from bore face 150 to the surface). Umbilical cord 130 may also be configured to provide electrical power, combustion material, and/or gas between chassis 110 and onsite facility 170. Though the embodiment described herein may communicate data and/or signals via a physical connection through umbilical cord 130, it is appreciated that, in certain other embodiments, such data and/or signals may be communicated wirelessly.

Onsite facility 170 and/or offsite controller 172 may be configured to provide instructions for boring operations (e.g., to chassis 110 and/or the boring elements thereof). Onsite facility 170 may be located within the general geographical vicinity of the job site, while offsite controller 172 may be located offsite. In certain embodiments, onsite facility 170 may include a controller and may communicate with offsite controller 172 via one or more data connections (e.g., Internet or other such connections). In various embodiments, one or both of onsite facility 170 and/or offsite controller 172 may not be present. In certain embodiments, chassis 110 may include its own controller 120. Variously, the controller(s) may provide instructions such as instructions for operation of the boring elements, chassis 110, and/or other portions of system 100. The controllers described herein may include one or a mixture of computing devices (e.g., computers) that allow for the determination of data and/or instructions.

In certain embodiments, offsite controller 172 may, additionally or alternatively, include additional facilities. Thus, for example, such offsite facilities may be configured to receive spoil samples from boring and may be configured to perform analysis of such spoil. For example, the offsite facilities may include an x-ray diffraction (XRD) analyzer, a laser induced breakdown spectroscopy (LIBS) analyzer, a laser induced fluorescence (LIF) analyzer, a Raman spectrometer, a mass spectrometer, a scanning electron microscope, an energy-dispersive x-ray spectroscopy, and/or an x-ray fluorescence analyzer, and/or any similar analytical technique to perform analysis of the spoil or similar geological feature.

Figure 1B:
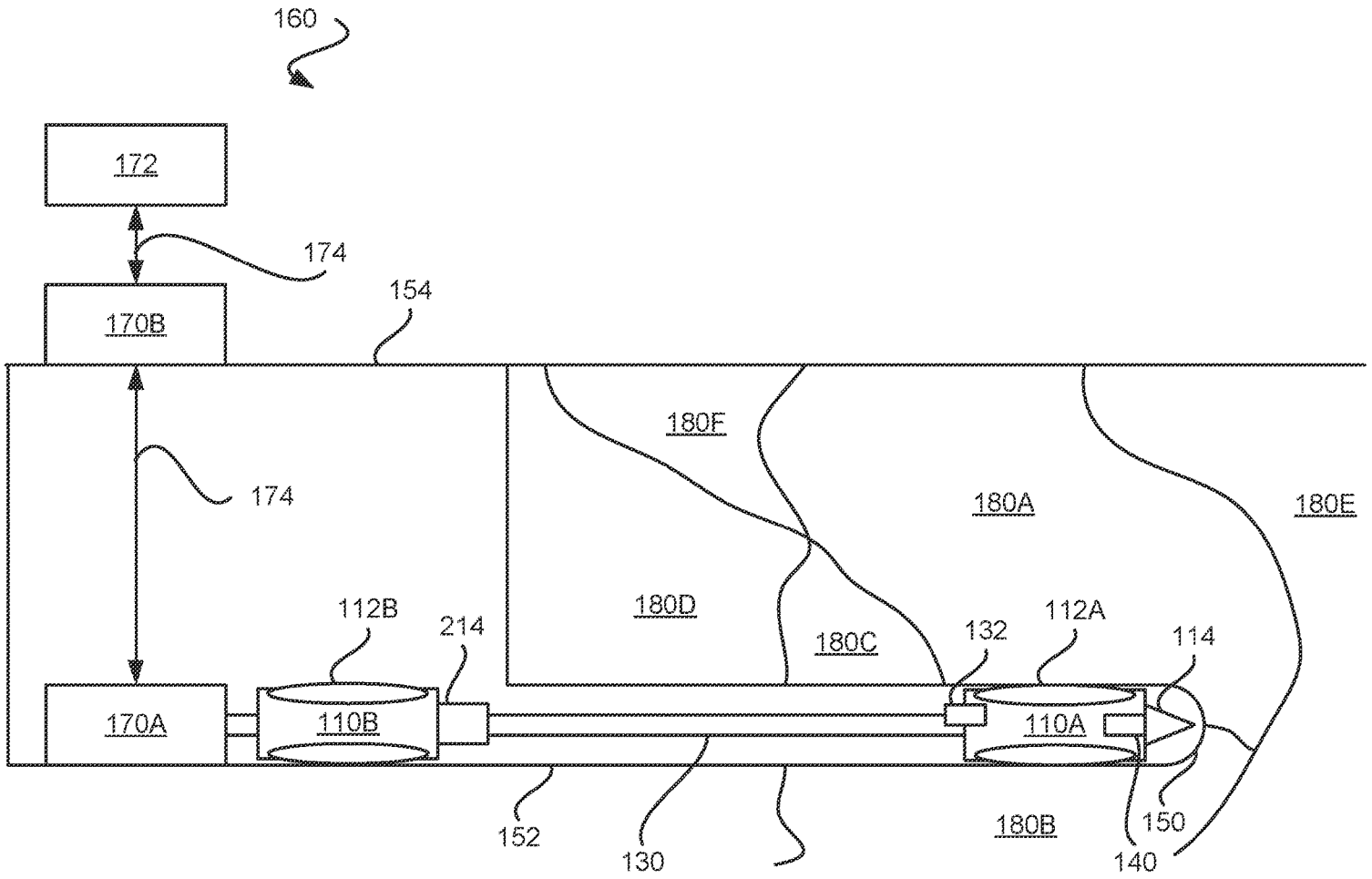
FIG. 1B illustrates a representation of another example boring situation, in accordance with certain embodiments.

In certain embodiments, onsite facility 170 may include various different auxiliary components of system 100. Thus, for example, onsite facility 170 may include components such as support vehicles (e.g., vacuum truck, water truck, fuel truck), spoil handling facilities, and/or analysis labs (e.g., for analysis of spoil to determine mineral composition, according to the techniques described herein). In various embodiments, onsite facility 170 may be located proximate to borehole 152, pit 154 (as shown in FIG. 1B), within pit 154, and/or within a distance away from the boring site.

The controllers may also be configured to receive data from various sensors of system 100. The controllers may utilize such data to determine conditions of borehole 152, such as conditions at bore face 150. For example, such data may allow for one or more controllers to generate a map (e.g., an optical map) of bore face 150 based upon an optical composition model determined from optical data from an optical sensor. The controllers may cause system 100 to adjust the operation of non-contact and/or contact boring elements currently in use (e.g., through adjustment of power output, stand-off distance, and/or other elements of non-contact boring elements and/or through adjustment of a boring speed of contact boring elements). The controllers may, additionally or alternatively, cause system 100 to transition between non-contact and contact boring elements, according to the techniques described herein, and may further control the targeting and/or aiming of non-contact boring element 114 and/or contact boring element 214, based upon the detected conditions.

The controllers may operate the boring elements during various phases of boring operations. Thus, one, some, or all of the controllers described herein may receive data, monitor sensors, measure parameters, determine states of the system, determine corrections, adapt to changes in the geology of the bore face 150, and/or transmit instructions and directions to one or more components (e.g., boring elements), subsystems, actuators, or sensors of system 100 in order to improve or optimize the performance of system 100 (e.g., boring rate or energy consumption) in an autonomous or substantially autonomous manner.

System 100 may be operated in formations with varying geological conditions. For example, in the example of FIG. 1A, system 100 may be operated in a mixed geological environment that includes geological regions 180A-F. Each such region may include different geological conditions, such as different types of rock, geological formations with varying hardness, abrasivity, intactness, soil types, different concentrations of ground water and/or void space, different geological types, and/or other such differences in conditions. In certain embodiments, system 100 may adjust the operation of and/or switch between non-contact and contact boring elements based on the detected conditions. When certain boring elements (e.g., non-contact boring element 114) is not operating (e.g., while contact boring element 214 is operating), such elements may be hidden (e.g., retracted) within chassis 110 to protect from debris and the environmental conditions of boring. Such techniques for hiding elements may also apply to other components of system 100, such as the sensors.

In certain situations, bore face 150 may include a mix of geological regions, such as a mix of geological regions 180A and 180B, as illustrated herein. The systems and techniques described herein allow for the optimization of boring operations in such mixed conditions. Additionally, system 100 may bore through a plurality of different geological regions, such as geological regions 180A, 180B, 180C, 180D, and 180E (though not geological region 180F). The systems and techniques described herein allow for the adjustment of operation of system 100 while boring through each of these geological regions.

FIG. 1B illustrates a representation of another example boring situation, in accordance with certain embodiments. FIG. 1B illustrates system 160 that may be another boring scenario. In FIG. 1B, pit 154 may first be excavated (e.g., through conventional techniques). Thus, for example, pit 154 may be a shallow trench, a pit, a quarry, a shaft, and/or another such subterranean feature. For purposes of this disclosure, "pit 154" may be any type of subterranean feature that may allow for the housing of equipment and/or the launching of boring systems. Once pit 154 has been excavated, tools for boring, such as onsite facility 170A and various bore heads, may then be placed within pit 154. In certain embodiments, equipment, such as onsite facility 170B, may also be placed on the surface. System 160 may be accordingly set up through the digging of a trench (a.k.a. a pit, for the placement of certain boring equipment, which may be distinct from "trenching" as a tunneling technique) at the start of the borehole 152 and system 160 may then be placed within the trench (e.g., pit 154). Systems for operation of one or more boring elements (e.g., non-contact boring element 114) may then be accordingly coupled (e.g., fuel or air supplies may be coupled and provided via umbilical 130). Borehole 152 may then be bored with the various techniques described herein.

While illustrative reference is made herein to "borehole 152," the systems and techniques described herein may be utilized within boreholes, in drilling techniques, in pipes (e.g., carrier pipes), and/or in any other such supported or unsupported subterranean environments. It is appreciated that, for the purposes of this disclosure, "borehole" is used as an all-encompassing term and may refer to any such supported or unsupported subterranean environment. Furthermore, such subterranean environments may include varying cross-sectional dimensions (e.g., varying hole diameters and/or varying non-circular shapes, such as D-shaped boreholes with a flat bottom). Thus, for example, for pipe environments, the pipe type and/or diameter may vary.

In FIG. 1B, chassis 110A may include non-contact boring element 114 while chassis 110B may include contact boring element 214. In certain embodiments, a single chassis may house or support a single boring element. A non-contact or contact boring element may be selected and operated. Thus, in the example of FIG. 1B, chassis 110A with non-contact boring element 114A may be currently selected for boring operations (e.g., may be launched from pit 154 and may bore through the geological formation and, thus, create borehole 152). In certain embodiments, a determination may be made during boring operations that another boring element may be better suited for conditions. While certain embodiments may include a plurality of switchable boring elements on a single chassis, the embodiment shown in FIG. 1B may switch boring elements by removing chassis 110A from borehole 152 and inserting a chassis with the more suitable boring element (e.g., contact boring element 214 of chassis 110B). The more suitable boring element may then be operated (e.g., by onsite facility 170A/B and/or via umbilical 130, which it might be coupled to) until a further determination is made to switch boring elements.

Figure 1C:
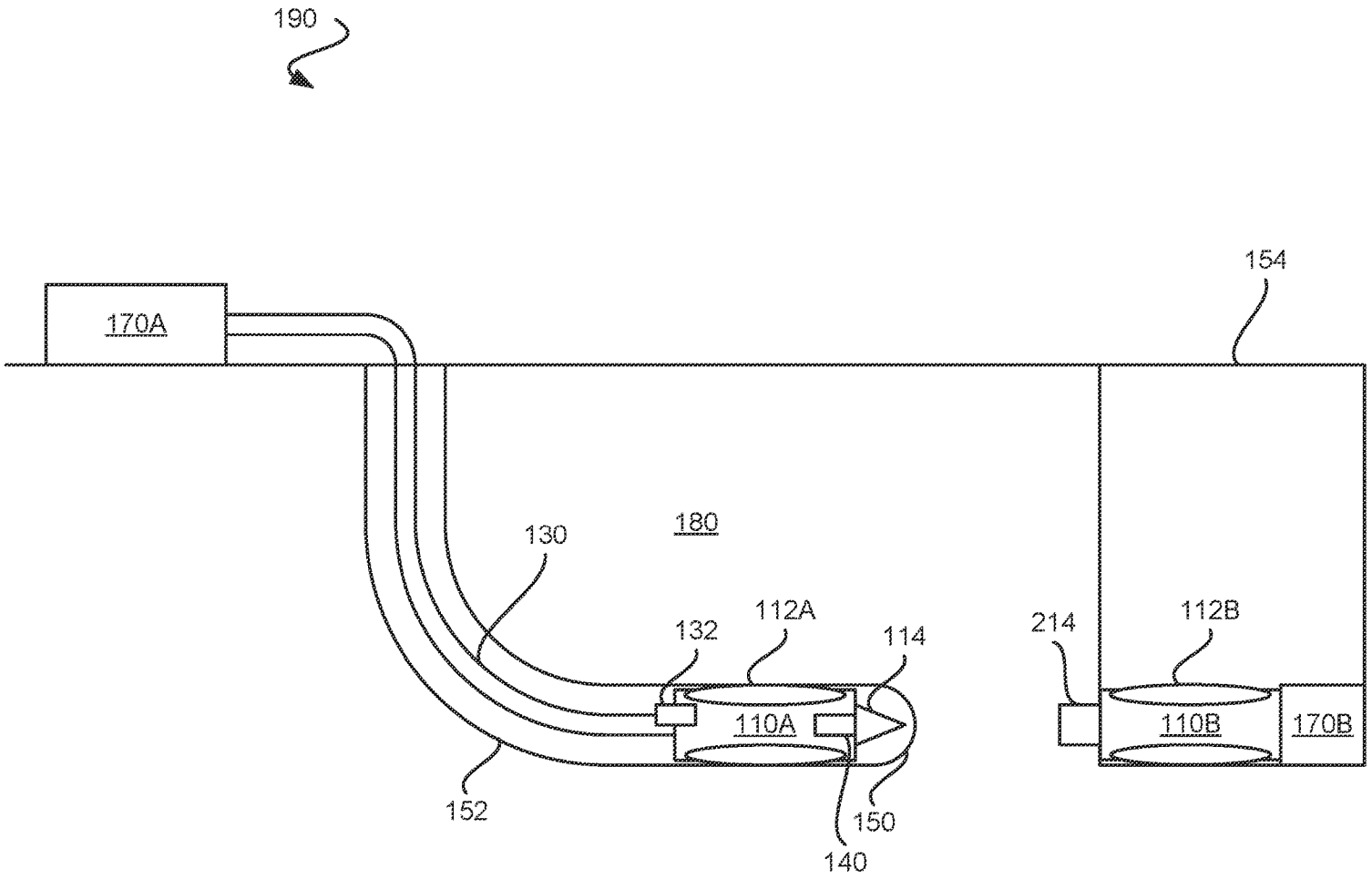
FIG. 1C illustrates a representation of a further example boring situation, in accordance with certain embodiments.

FIG. 1C illustrates a representation of a further example boring situation, in accordance with certain embodiments. FIG. 1C illustrates system 190 where chassis 110A may be boring through borehole 152 towards pit 154. In various embodiments, chassis 110A may be communicatively coupled to onsite facility 170A and/or onsite facility 170B, disposed within pit 154. Thus, in certain such embodiments, chassis 110A may be boring towards onsite facility 170B located within pit 154. In certain embodiments, one of onsite facilities 170A and 170B may be located elsewhere and/or may not be present.

Furthermore, in certain embodiments, onsite facility 170B may include its own associated bore head (e.g., associated with chassis 110B) which may be, for example, boring from pit 154 towards borehole 152. Such an operation may be a "meet in the middle" operation. In certain such operations, chassis 110A and 110B may approach each other and the final operations of completing the hole may be via a pipe welding/joining technique, such as from a pipe welding/joining robot.

FIG. 2 illustrates a side view of an example bore head, in accordance with certain embodiments. FIG. 2 illustrates bore head 200 that includes chassis 110, non-contact boring positioning element 116, non-contact boring element 114, contact boring positioning element 216, contact boring element 214, controller 120, spoil evacuator 132, filtration or collection element 140, and sensors 118. Bore head 200 may be a boring machine that may freely move within boreholes and may be easily removable for ease of maintenance, repair, tool swapping, method swapping, and/or other such maintenance activities.

In various embodiments, a reference numeral may apply to a plurality of similar elements (e.g., sensors 118A-D), each denoted by different letters. Reference to just the number element itself may indicate that the description applies to elements that share the number reference.

Non-contact boring positioning element 116 of bore head 200 may be configured to locate non-contact boring element 114 relative to chassis 110. That is, non-contact boring positioning element 116 may advance and retract non-contact boring element 114 longitudinally, laterally, and/or vertically relative to chassis 110 as well as tilt non-contact boring element 114 in pitch and yaw on chassis 110 (e.g., by up to +/−30° or another such angle).

In certain embodiments, non-contact boring element 114 may be configured to provide boring through mass flow. Non-contact boring element 114 may, for example, be a fully-contained cutterhead that includes a Brayton-cycle turbojet engine configured to compress fresh air from an above-ground air supply within a compressor of the engine and configured to mix this compressed air with fuel from an above-ground fuel source. This fuel-air mixture may be combusted to provide energy to drive the compressor and exhausted to provide high temperature and high mass flow rate exhaust gases toward a face of an underground bore (e.g., bore face 150). These high temperature and high mass flow rate exhaust gases may reach bore face 150 within a jet impingement area, which may be an area of focus for non-contact boring. The exhaust gases may shock geologies at bore face 150, leading to spallation or other removal means of geologies and removal of rock spall from bore face 150.

Various sensors 118 (shown in FIG. 2) may be configured to sense certain parameters of boring and allow for adjustment of certain aspects of boring. Sensors 118 may include, for example, a temperature sensor configured to output a signal representing the temperature of these exhaust gases. Controller 120 may be configured to receive such data signals and, in response, vary the fuel flow rate into the engine and/or adjust other boring parameters within the engine in order to maintain the temperature of these exhaust gases below the minimum melting temperature of all geologies present at the face (e.g., less than 1400° C. for certain geologies) or below the melting temperature of a particular geology detected at bore face 150 in order to maintain a high volume of rock removal per unit time and per unit energy consumed by the system 100.

Non-contact boring element 114 may bore through geological formations via thermal spallation by directing a high-energy (e.g., high-temperature and/or and high mass flow rate) stream of exhaust gases toward bore face 150. These exhaust gases rapidly transfer thermal energy into the surface of bore face 150, resulting in rapid thermal expansion of a thin layer at the surface of bore face 150. Expansion and local stresses may occur along natural discontinuities and nonuniformities that exist in the microstructure of the rock matrix of geological formations, causing differential expansion of the minerals of which the geological formation is composed thereof. The differential expansion may cause stresses and strains along and between mineral grains. Because geologies are typically brittle, rapid thermal expansion of the thin, hot surface layer at bore face 150 may cause the surface layer to fracture from the cooler geological formation (e.g., rock) behind bore face 150 and break into rock fragments (or spall) and separate from the surface of bore face 150 during this spallation process. The mechanism of fracturing or induction of micro-stresses at the surface of the bore face may vary across lithologies based on mineralogy, material properties, chemical properties, and physical properties of the surface subjected to these exhaust gases.

However, if the temperature of the exhaust gases reaching bore face 150 exceeds the melting temperature of the geological material at the surface of bore face 150, the surface of bore face 150 may melt rather than fracture and release from bore face 150. Certain non-contact boring techniques are configured to operate via spallation and, thus, such non-contact boring techniques may be operated to avoid the melting of bore face 150.

In certain embodiments, the engine may be, for example, a Brayton-cycle turbojet engine with its outlet nozzle facing toward bore face 150. The engine may be configured to generate high-temperature exhaust gases and to direct these exhaust gases at a high mass flow rate in order to maintain a high pressure and a high total heat flux at bore face 150 and to achieve rapid spallation and material removal from bore face 150. In various embodiments, the various controllers described herein may implement closed-loop controls to maintain the temperature of the exhaust gases to below that of the melting temperature of all geologies (e.g., 825° C. to compensate for melting temperatures between 900° C. and 1400° C. for most geologies) or below the melting temperature of a particular geology detected at bore face 150. The engine may also maintain a high mass flow rate in order to compensate for the sub-melting temperature exhaust temperatures in order to generate high heat flux at bore face 150 and, therefore, a high rate of spallation at bore face 150.

In certain embodiments, the engine for non-contact boring element 114 may include a combustor that burns fuels, a turbine that transforms pressure and thermal energy of gases exiting the combustor into mechanical rotation of a driveshaft, and an integrated axial compressor that is powered by the turbine via the driveshaft to draw air into the engine, to compress air, and to feed air into the combustor. An air supply (e.g., from onsite facility 170) may provide aboveground air to the engine and a fuel supply may provide fuel to the engine from an above ground supply (e.g., a fuel tank). Onsite facility 170 may monitor the air and fuel provided to the engine, as well as the completeness of combustion and other operating aspects.

Contact boring positioning element 216 may be configured to locate contact boring element 214. Contact boring positioning element 216 may be configured to locate the contact boring element 214 relative to chassis 110 by, for example, moving contact boring element 214 longitudinally, laterally, vertically, and/or tilting in pitch and yaw relative to chassis 110. Such movements of non-contact boring element 114 and/or contact boring element 214 may be further described in FIG. 3.

Figure 3:
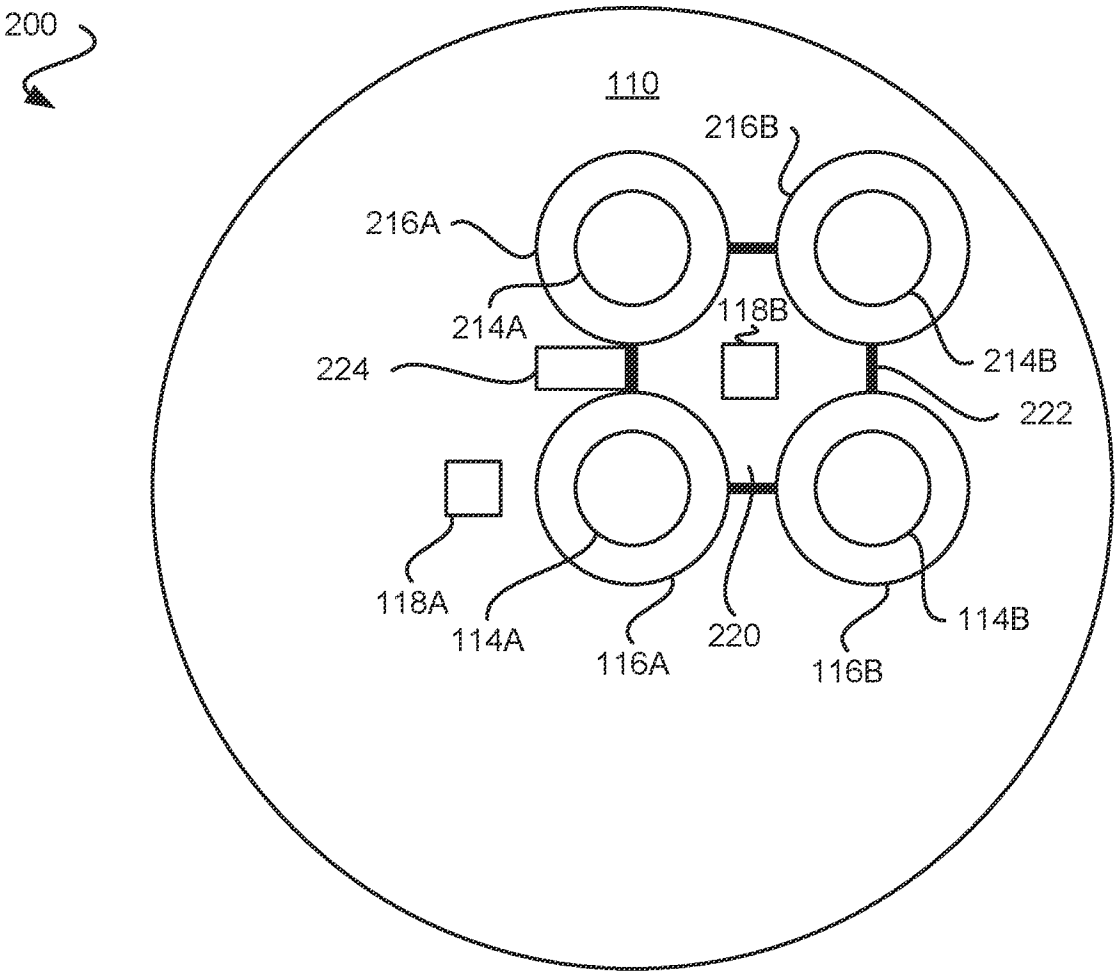
FIG. 3 illustrates a front view of an example bore head, in accordance with certain embodiments.

FIG. 3 illustrates a front view of an example bore head, in accordance with certain embodiments. FIG. 3 illustrates a front view of bore head 200 that includes chassis 110, a plurality of non-contact boring positioning elements 116A and 116B, each locating a respective non-contact boring elements 114A and 114B, and a plurality of contact boring positioning elements 216A and 216B, each locating a respective contact boring elements 214A and 214B.

In a certain embodiment, the various boring elements and boring positioning elements may be coupled to and located via rotating platform 220. Rotating platform 220 may be coupled to chassis 110 and may rotate the positions of the various boring elements and boring positioning elements that are mounted to rotating platform 220. In certain embodiments, rotating platform 220 may rotate the boring element to be used into the position of boring element 114A, as shown in FIG. 3 (e.g., in a central position of chassis 110). In other embodiments, some or any position on rotating platform 220 may be utilized for operation of a boring element. In certain embodiments, rotating platform 220 may be configured to allow each of the boring elements to be oriented at any point along the front face of chassis 110, to allow for the appropriate mode of boring can be executed on bore face 150 by bore head 200. Additionally or alternatively, boring may be executed on the edge of bore face 150. Thus, non-contact boring may be executed through flame or water jets ejected from a non-contact boring element, such as along the body of chassis 110, in order to effect the main body of a tunnel to partially consolidate the ground for boring in, for example, a sandy or unconsolidated ground environment, and/or 2) contact boring may be executed through pipe ramming. One, some, or all boring elements described herein may allow for boring on bore face 150 and/or along the edge of bore face 150.

Additionally or alternatively, translational slots 222 may allow for the positioning of the boring elements and boring positioning elements. Thus, for example, the boring elements and boring positioning elements may slide within translational slots to reposition. In various embodiments, translational slots 222 allow for the boring elements and boring positioning elements to be repositioned vertically and/or laterally.

In various embodiments, translational slots 222 may include, for example, a chain or other conveyor system. The conveyor system may be operated by actuator 224 to position the boring elements and boring positioning elements. Actuator 224 may be, for example, a hydraulic actuator, electric motor, mechanical pulley, and/or another such actuator configured to move the boring elements and boring positioning elements within translational slots 222. In certain other embodiments, actuator 224 may be configured to rotate rotating platform 220 to position the boring elements and boring positioning elements accordingly.

In certain embodiments, bore head 200 may include sensors 118, which may be sensors configured to detect certain conditions associated with boring. Referring to both FIGS. 2 and 3, such sensors may be disposed on various portions of bore head 200 and/or system 100. Thus, for example, sensor 118A may be disposed on the front section of chassis 110 in a fixed location. Accordingly, sensor 118A may be disposed in a fixed relation to the rest of chassis 110. Sensor 118B may be disposed on a movable portion of bore head 200, such as on rotating platform 220. Sensor 118C may be disposed proximate to spoil evacuator 132. Sensor 118D may be disposed within umbilical cord 130 and/or other behind chassis 110. Sensors 118C and 118D may be configured to, for example, determine aspects of the waste from boring at various points of where the waste is evacuated.

Sensors 118 may be, for example, a thermocouple, an air temperature sensor, a resistance temperature detector (RTD) sensor, a speed/torque sensor, a pressure transducer, a pressure sensor, an electrical output sensor, a flow rate sensor, a water pressure sensor, a water temperature sensor, a water electrical conductivity sensor, a spectropyrometer, a gas flow meter, a height sensor, a potentiometer, a clearance sensor, an accelerometer, a gyroscope, a tachometer or revolutions per minute (RPM) sensor, lidar, radar, a camera (e.g., a red-green-blue or RGB camera, hyperspectral camera, thermal camera, and/or another such camera), an acoustic sensor, a vibration sensor, a structured light sensor, and/or another such sensor. For certain embodiments, sensor 118A and/or 118B may be, for example, a camera, radar, lidar, and/or other such sensor and may be configured to determine stand-off distance 260 of non-contact boring mechanism 114 from bore face 150. In another embodiment, sensor 118A and/or 118B may be configured to determine a power output of non-contact boring mechanism 114 (e.g., to, for example, determine a temperature of exhaust and/or plasma outputted by non-contact boring mechanism 114). Stand-off distance 260 may be a distance of inches or feet and stand-off distance 260 may first be implemented as a nominal stand-off distance (e.g., 6 inches) and then adjusted during operation. Stand-off distance 260 and/or power output may, for example, affect how flame front 156 of non-contact boring mechanism 114 may perform during non-contact boring of bore face 150 (e.g., may adjust the intensity and size of the jet impingement area of flame front 156). Other sensor types may allow for the determination of other aspects of operation.

Sensor 118A and/or 118B, as well as another sensor, may be, for example, a single depth sensor or a contact probe 192 configured to extend toward and retract from bore face 150. Such a sensor may determine (e.g., periodically, based on observed conditions, and/or via trigger commands provided by an operator) stand-off distance 260. Based on the measured stand-off distance 260, as well as other measured parameters, controller 120 may adjust a boring parameter (e.g., air flow, fuel flow, gas flow, electrical power) of non-contact boring element 114 to improve boring performance (e.g., by reducing the surface temperature at bore face 150 to improve spallation).

Non-limiting examples of various appropriate sensors are provided below:

| Sensor type | Location | Sensing metric |
|---|---|---|
| Thermocouple | General | Temperature measurements, including exhaust temperature measurements for non-contact boring element |
| Air temperature sensor | General | Stagnation temperature |
| RTD sensor | General | Temperature measurements, including exhaust temperature measurements for non-contact boring element |
| Speed/torque sensor | In engines and other rotational applications | Speed and torque of engine shafts/rods, gears, or blades (e.g., in a turbine). |
| Pressure transducer | Used for pressure measurement of low-temperature regions of engine (including uncombusted fuel/fuel line temperatures) | Pressure |
| Pressure sensor | Used for measuring internal pressures in an engine/turbine | Pressure |
| Electrical output sensor | Electrical power supply | Voltage, current, and power |
| Flow rate sensor | Within manifolds | Flow rate of gases and liquids |
| Water pressure and flow rate sensor | Water manifold | Pressure |
| Water temperature sensor | Water manifold | Temperature |
| Water electrical conductivity | Water manifold | Conductivity (e.g., as a proxy for dissolved solids) |
| Spectropyrometer | Laboratory (for plume temperature profiling in a controlled environment) | Thermal radiation at a wide variety of wavelengths to estimate a temperature and enthalpy |
| Gas flow meter | Gas valves | Flow rate of oxygen and of other combustive gas |
| Displacement sensor | General | Changes in the location of a physical point of contact (e.g., at the bore face) |
| Absolute linear position sensor | General | Absolute positon of a physical point of contact along an axis of interest |
| Potentiometer | Acetylene torch cutterhead | Resistance across two leads |
| Clearance sensor | General | Amount of space from head to bore face |
| Accelerometer | General | Acceleration of chassis, for speed, distance traveled, acceleration (e.g., for advance rate) |
| Gyroscope | General | Orientation |
| RPM sensor | Motors | Rotational velocity |
| Lidar | General | Distance to objects or depth based on time of flight measurement for measuring of stand-off distance and/or distance to portions of a tunnel, such as distance off the ground |
| Camera | General | General (e.g., RGB) vision used to differentiate objects of different colors or textures, based on visible light, as well as identify the amount of distance traveled |

-continued

| Sensor type | Location | Sensing metric |
|---|---|---|
| Hyperspectral camera | General | Electromagnetic radiation in a wide variety of wavelengths with the purpose of identifying and distinguishing geologic features |
| Thermal camera | General | Thermal radiation to determine the temperature of objects |
| Radar | General | Distance to objects or depth based on time of flight measurement for measuring of stand-off distance and/or distance to portions of a tunnel, such as distance off the ground |
| Acoustic sensor | General | Acoustic signatures |
| Magnetometer | General | Orientation of magnetic fields |
| Vibration sensor | General | Sound waves, traveling through air or solids, which may indicate motion, machine performance, geological conditions, and/or other such conditions |
| Structured light sensor | General | Projects grid array and images to determine curvature/structure/distance/joint patterns for curved surfaces of tunnel face |

Referring back to FIG. 2, the various sensors 118 and/or boring mechanisms may be communicatively coupled to controller 120. Controller 120 may be configured to receive data from various components of system 100 and/or bore head 200. Controller 120 may include, for example, a processor and a memory and may be configured to receive data (e.g., operating or sensor data) and provide data (e.g., instructions) to the various components of system 100 and/or bore head 200 via communications interfaces 122. Communications interfaces 122 may be, for example, any wired and/or wireless communications technique that allows for the communication of data between components.

Example Boring Scenarios

Figure 4:
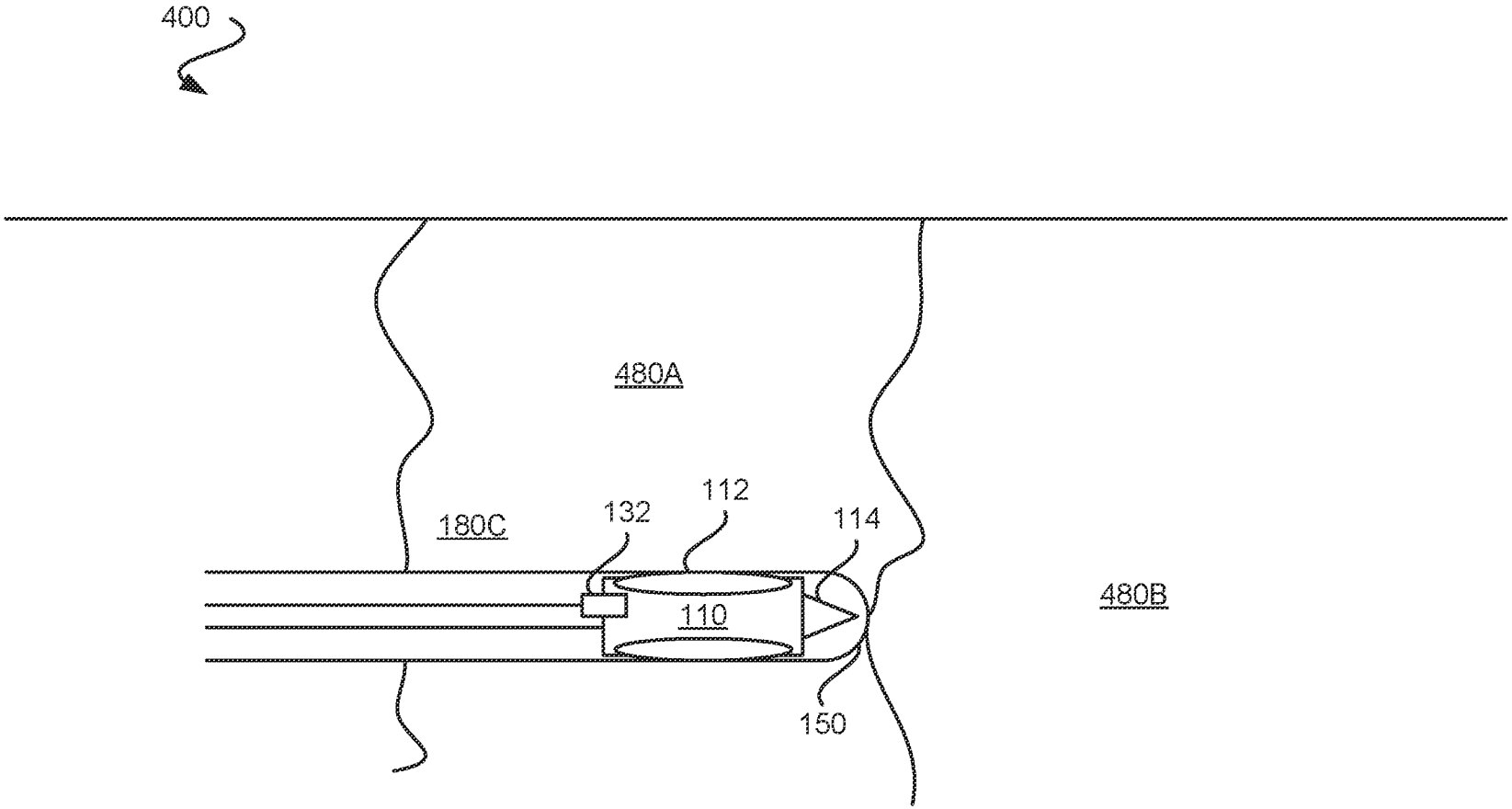
FIGS. 4-5 are representations of example boring situations, in accordance with certain embodiments.
Figure 5:
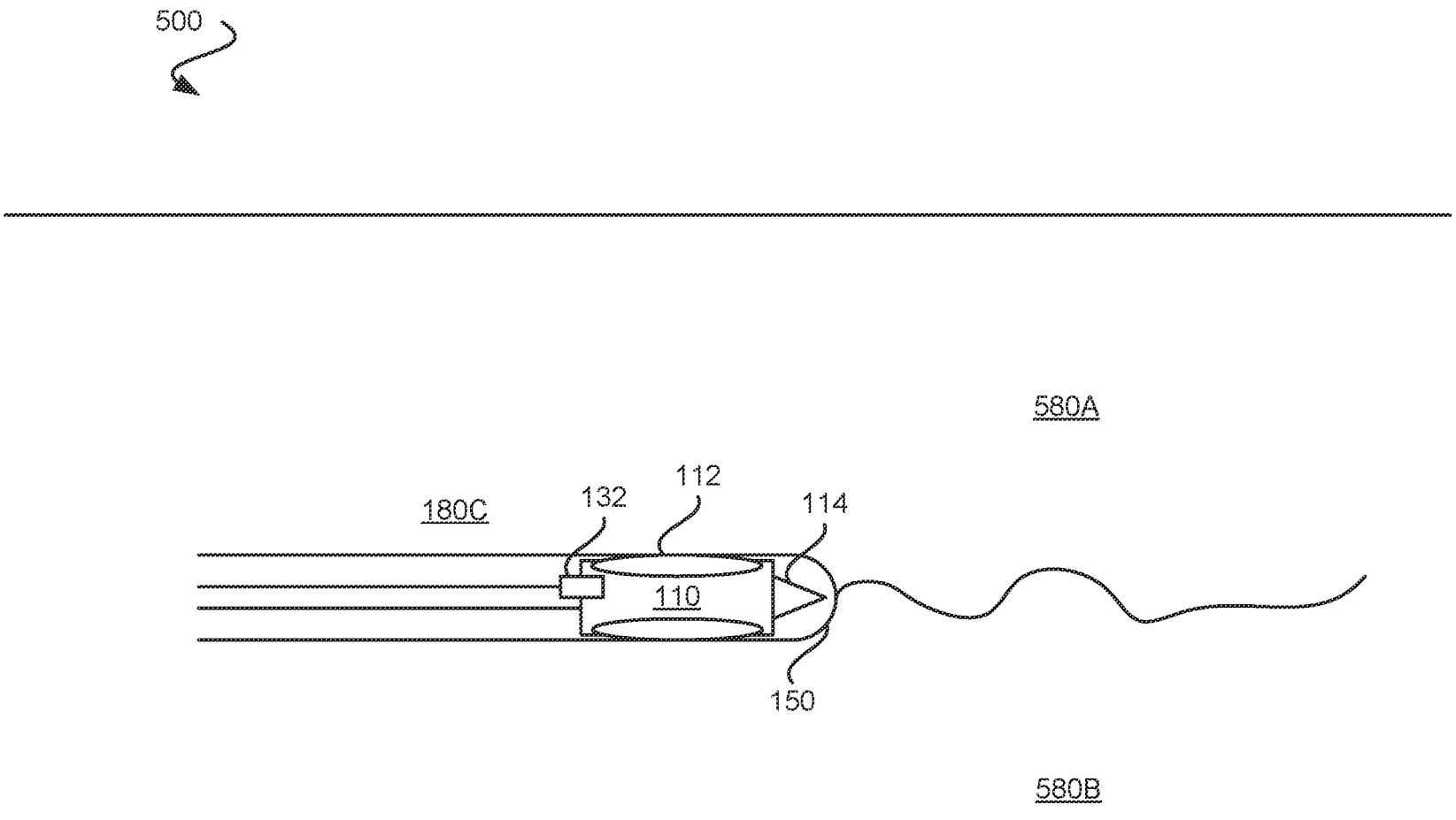

FIGS. 4-5 are representations of example boring situations, in accordance with certain embodiments. FIG. 4 illustrates scenario 400 where chassis 110 is performing non-contact boring via non-contact boring mechanism 114 within a formation that includes geological regions 480A and 480B. At first, the bore head may be boring through geological region 480A. However, as bore face 150 reaches geological region 480B, conditions may change and the operation of non-contact boring mechanism 114 may be non-optimal. As such, a new boring mechanism or tool (e.g., another non-contact boring mechanism or a contact boring mechanism) may be selected or operation of non-contact boring mechanism 114 may be adjusted (e.g., the stand-off distance or power output may be adjusted). Such selection or adjustment may allow for more optimized boring through geological region 480B.

FIG. 5 illustrates scenario 500 where chassis 110 is performing non-contact boring mechanism 114 within a formation where both geological regions 580A and 580B are present on bore face 150. In certain embodiments, non-contact boring mechanism 114 may be configured to bore a portion of bore face 150 (e.g., the portion of bore face 150 that includes geological region 580A). The configuration of non-contact boring mechanism 114 for the characteristics of geological region 580A may render it sub-optimal for boring geological region 580B. Accordingly, in certain embodiments, for boring the portion of bore face 150 that includes geological region 580B, a new boring rig, mechanism, or tool (e.g., another non-contact boring mechanism or a contact boring mechanism) may be selected or operation of non-contact boring mechanism 114 may be adjusted. Such selection or adjustment may allow for more optimized boring of the portion of bore face 150 that includes geological region 580B.

The geological conditions (e.g., of the geological regions described herein) may be determined via data from sensors 118. In various embodiments, data from one or more sensors 118 may be provided to one or more controllers and utilized to determine the geological conditions of bore face 150 and/or other portions of borehole 152. Such determinations may cause operation of bore head 200 to be adjusted as various geological conditions may require different boring techniques, whether via contact or non-contact boring. Non-limiting examples of geological conditions, how to determine the conditions via data from sensors, and the operations for boring through such geological conditions are provided herein:

| Geological condition | Description | Example boring strategy | Technique of determination |
|---|---|---|---|
| Chemistry or mineralogy | Indicates the differences between chemistry (atoms, molecules) and mineralogy (crystals) of ground types. | Depending on characteristics, non-contact or contact boring may be utilized. The characteristics of the boring mechanism may also be adjusted based on the | Spectroscopy through the use of cameras (e.g., through longwave infrared images) may measure chemistry. Hyperspectral imaging may measure |

-continued

Figure 10:
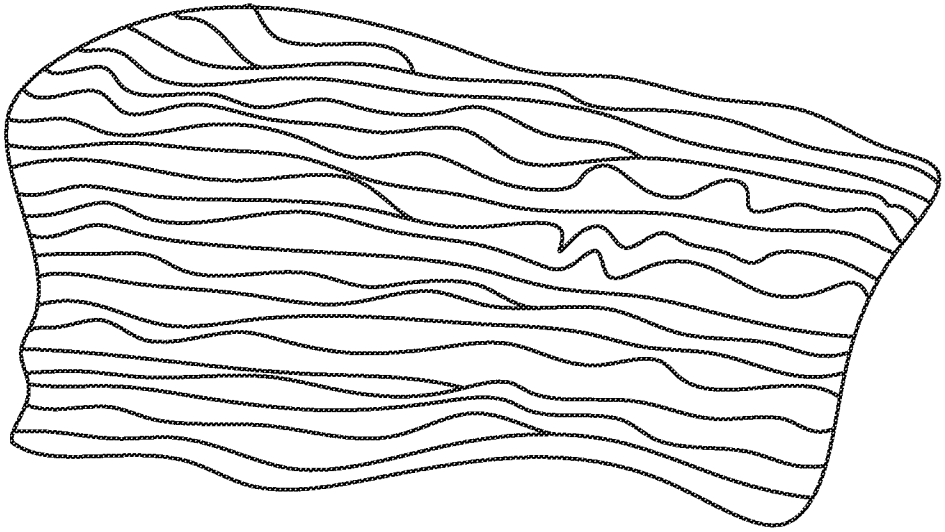
FIG. 10 illustrates an example of anisotropy in rock, in accordance with certain embodiments.
Figure 11:
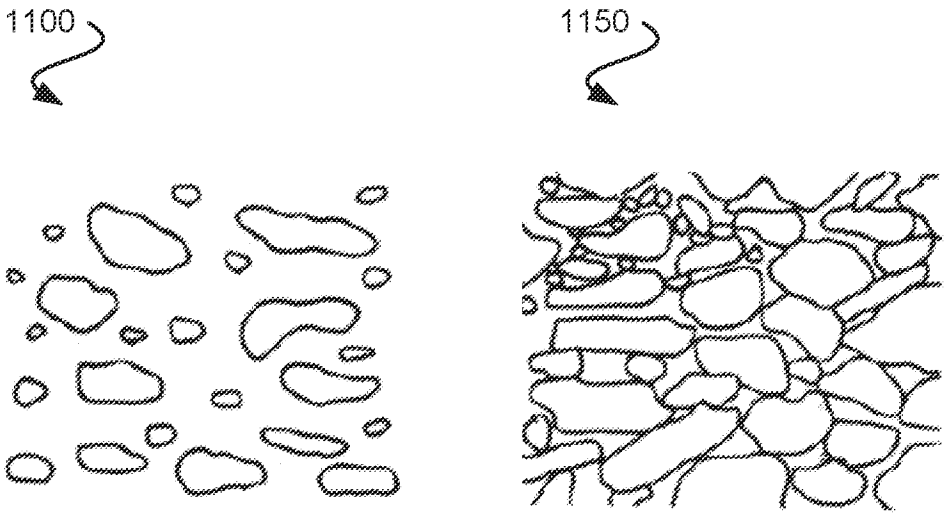
FIG. 11 illustrates examples of consolidation, in accordance with certain embodiments.
Figure 12:
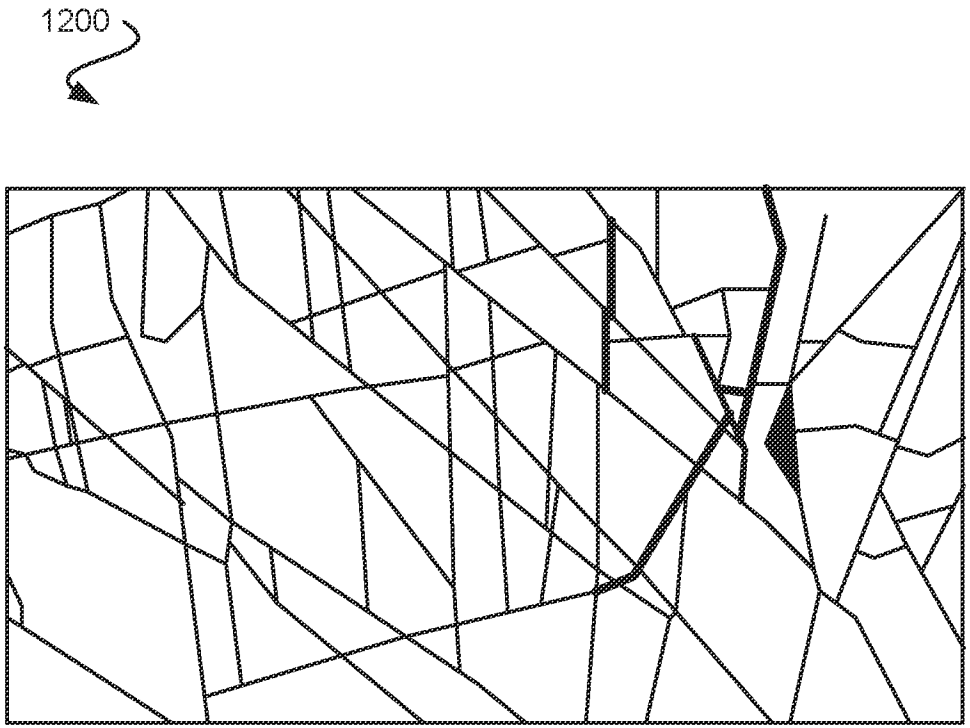
FIG. 12 illustrates an example of fractures, in accordance with certain embodiments.
Figure 13:
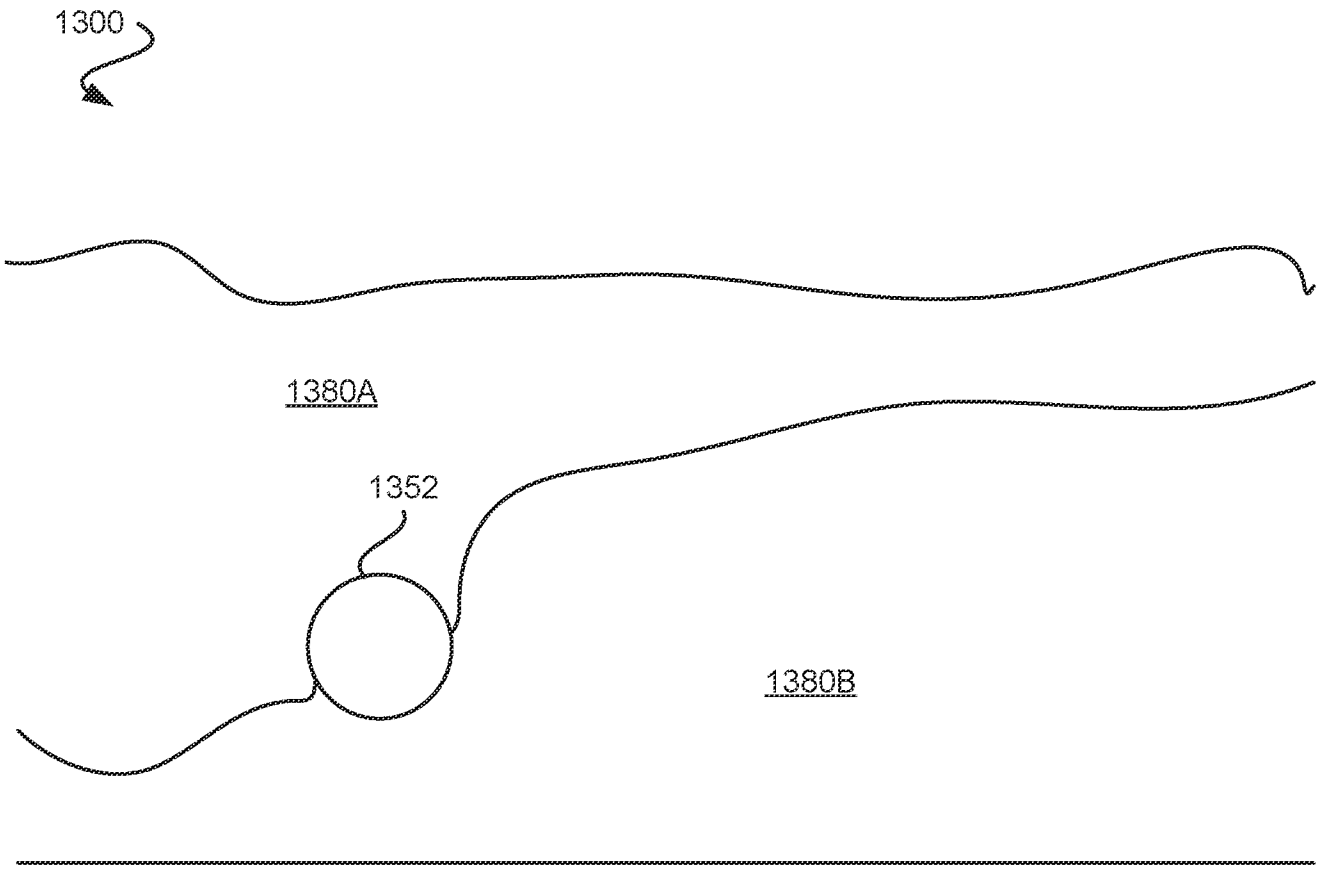
FIG. 13 illustrates an example of ground water within geological formations encountered during boring, in accordance with certain embodiments.

| Geological condition | Description | Example boring strategy | Technique of determination |
|---|---|---|---|
| | | chemistry or mineralogy. | mineralogy. Returned wavelengths may be correlated to material chemistry or mineralogy. |
| Void space | Void space may be regular porosity in sedimentary rocks, irregular vugginess in limestone/dolostone, or vesicularity in igneous rocks. Fabric selective, not fabric selective, and fabric selective or not pore systems may all be determined. | Based on the void space of a formation, non-contact or contact boring may be selected. | Imaging with an optical camera either of the bore face or of the spoil. Change in spoil size and shape (measured at any point where the spoil is communicated) may also indicate change in void space. Acoustic signature of boring, either measured through an acoustic sensor or a vibration sensor, may also indicate void space. |
| Bedding, foliation, and schistosity | Examples of anisotropy encountered in rock. Orientations may vary locally based on different scales. FIG. 10 illustrates an example 1000 of anisotropy in rock, in accordance with certain embodiments. | The bore head may be specifically oriented for efficient non-contact boring in these conditions. | Optical or hyperspectral camera at the bore face. Monitoring orientation of planes relative to spoil geometry. |
| Degree of consolidation | Ground types like soil are unconsolidated (not structurally sound) while hard rock is consolidated. Pockets of unconsolidated material may occur in otherwise hard rock. FIG. 11 illustrates examples of consolidation, in accordance with certain embodiments. Example 1100 illustrates unconsolidated ground while example 1150 illustrates consolidated ground. | Degree of consolidation may inform the decision of whether to use contact or non-contact boring techniques. | Decrease in advance rate (in units of distance per time ) or excavation rate (in volume per time) for non-contact boring. Optical imaging of face. Acoustic signature of boring. |
| Joint spacing, orientation, and aperture | Joints are fractures in rock which tend to be systematic. Orientation and aperture (width) vary widely. FIG. 12 illustrates an example 1200 of fractures, in accordance with certain embodiments. | Amount, magnitude, and orientation of joint spacing may inform whether to use non-contact or contact boring techniques. | Optical camera at the bore face. Acoustic signature of boring. |
| Ground water | Ground water may be in situ or flowing. Inflow flow rates may vary by orders of magnitude between different locations. FIG. 13 illustrates an example of ground water within geological formations encountered during boring, as further detailed herein. | Contact boring may be utilized in geological conditions with excessive ground water. | Thermocouples measuring gas temperature at the bore face or exit may detect vertical temperature asymmetry caused by presence of excess water. |

-continued

| Geological condition | Description | Example boring strategy | Technique of determination |
|---|---|---|---|
| Compressive strength | Metric that has a high effect on conventional boring in rock. Often tested prior to projects. | Non-contact boring techniques may be utilized in high strength rock. | Decrease in advance rate at a given power level may indicate increase in UCS of rock. |

FIG. 13 illustrates an example of ground water within geological formations encountered during boring, in accordance with certain embodiments. Example 1300 illustrates a scenario where borehole 1352 is in between two geological regions 1380A and 1380B. Geological region 1380A may be ground that is unsaturated with water, while geological region 1380B may be ground that is saturated with water. The water saturation may manifest in gas temperature or pressure resulting from non-contact boring (e.g., the evaporated water may decrease the gas temperature and/or increase the gas pressure). Based on such a determination, a contact boring mechanism may be selected for boring instead of the non-contact boring mechanism.

Boring Techniques

Figure 6:
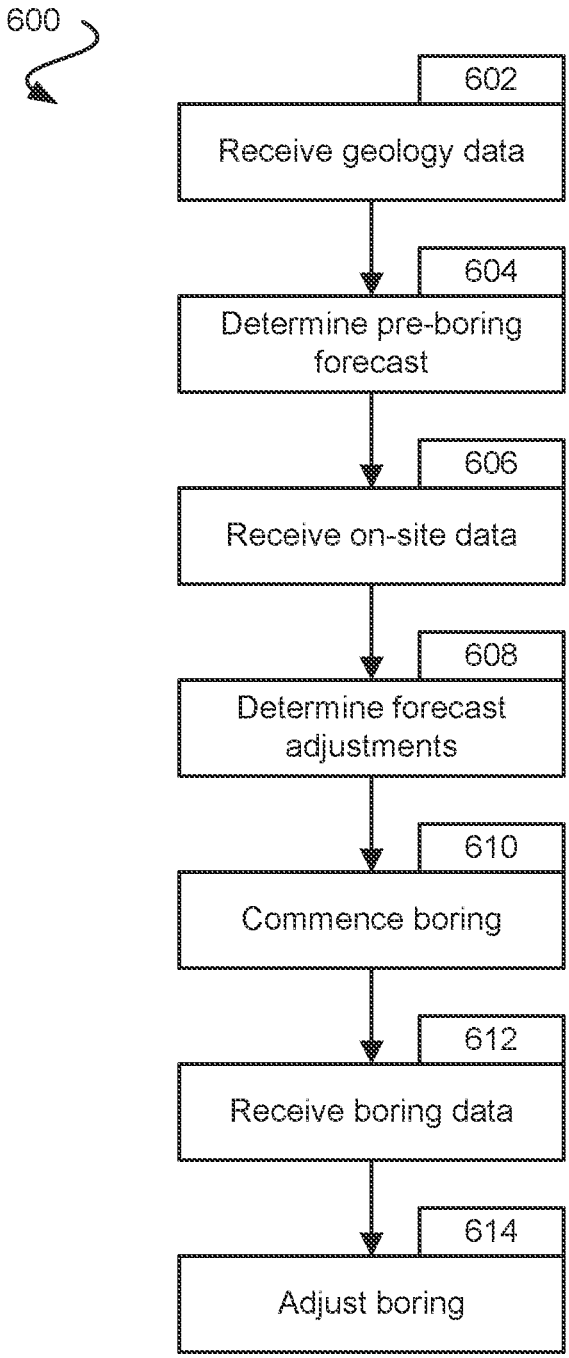
FIG. 6 is a flowchart detailing an example boring technique, in accordance with certain embodiments.

FIG. 6 is a flowchart detailing an example boring technique, in accordance with certain embodiments. FIG. 6 illustrates technique 600 where the boring mechanism and/or boring technique may be adjusted based on conditions at the bore face.

In 602, geology data associated with a boring site may be received. Such geology data may be based on pre-boring surveys, such as borehole logs, pilot tests, and/or other such pre-boring surveys. Geology data may allow for an estimate of the geological conditions that would likely be encountered during boring. Such geological conditions may be determined in a pre-boring forecast in 604. Based on the geology data received in 602, the geological conditions that are likely to be encountered during boring may be determined in the pre-boring forecast. The pre-boring forecast may include forecasts for the geological conditions that are likely to be encountered, as well as the boring technique (e.g., whether to use a specific non-contact or contact boring mechanism and the operation parameters thereof) to be utilized throughout boring (e.g., the techniques may be changed based on different geological regions that are forecasted). The pre-boring forecast may, thus, include a predetermined boring route as well as, in certain examples, one or more boring tool switching indications showing spots along the route where the boring technique may be changed (e.g., from non-contact boring to contact boring, or vice versa, as well as any potential changes in boring mechanism settings, as described herein) to accommodate the forecasted geological conditions. In various embodiments, 602 and 604 may be performed prior to the commencement of boring. Thus, for example, 602 and 604 may be performed by offsite controller 172.

In certain embodiments, forecasting, or a portion thereof, may be performed via machine learning techniques. Thus, for example, forecasting in 604 may be performed by a machine learning device trained to provide such forecasting. In certain embodiments, training of the machine learning device may include, for example, training through previous forecasts. Thus, for example, training data may include various examples or completed bores. The training data may include: 1) the geographical location of the boring site, 2) the pre-boring geological data (e.g., from surveys), 3) the pre-boring forecast, 4) on-site adjustments to the forecast, 5) data generated by the boring, 6) adjustments made during boring (e.g., adjustments made during boring based on data from sensors readings, including selection of new boring mechanisms and/or changes to operation of a selected boring mechanism), 7) the techniques used for boring and the results thereof (e.g., the boring mechanism and operation settings used, the geological conditions during such boring, and the results from such boring, including any off-plan deviations from the boring plan), and/or 8) other aspects of boring. The training data may, thus, be categorized based on the category of data (e.g., according to one, some, or all of the categories described herein).

The training data may allow for a determination, by the machine learning device, of relationships between geographical location, geological survey results, and actual boring results. Such training data may be provided to a neural network/machine learning device to train and/or refine boring forecasts and pre-boring instructions for boring systems, as well as instructions provided to boring systems during operation of such systems (e.g., to determine whether to change between non-contact and contact boring techniques).

In certain embodiments, the machine learning device may be continuously refined. Thus, for example, after a boring operation has been performed, the data from the boring operation, including data such as the pre-boring geological data received, the forecast provided, the operations performed and the results thereof, the sensor readings obtained during boring operations, and/or other data. In certain such embodiments, training data may be continuously created from completed boring operations and provided to the machine learning device to refine machine learning models.

In 606, once on-site, additional data may be received. Such data may be, for example, additional surveys or determinations of the conditions of the site. In 608, based on the additional data, adjustments to the forecast may be determined. The adjusted forecast of 608 may then be used for boring operations.

In 610, boring may commence at the site and boring data may be received from various sensors 118 of system 100 in 612. In certain embodiments, such boring may be initially performed according to the forecast. The boring may be boring in a non-contact boring state, boring in a contact boring state, or boring in a hybrid boring state that is a combination of both non-contact boring and contact boring. The on-site data may allow for the determination of downhole conditions, such as the conditions of bore face 150.

The conditions determined from the data may indicate that the conditions (e.g., geological conditions) of bore face 150 may be different from that of the forecast. Thus, for example, the geological conditions of bore face 150 may be determined to be different from that of the forecast. Accordingly, in 614, the boring operation may be adjusted based on the determination. Adjustment of the boring operation may include, for example, switching between various boring mechanisms (e.g., non-contact and/or contact boring mechanisms) or changing aspects of operation of the selected boring mechanisms (e.g., changing the torque, rpm, power output, stand-off distance, and/or other aspects of operation of the selected boring mechanism).

Figure 7:
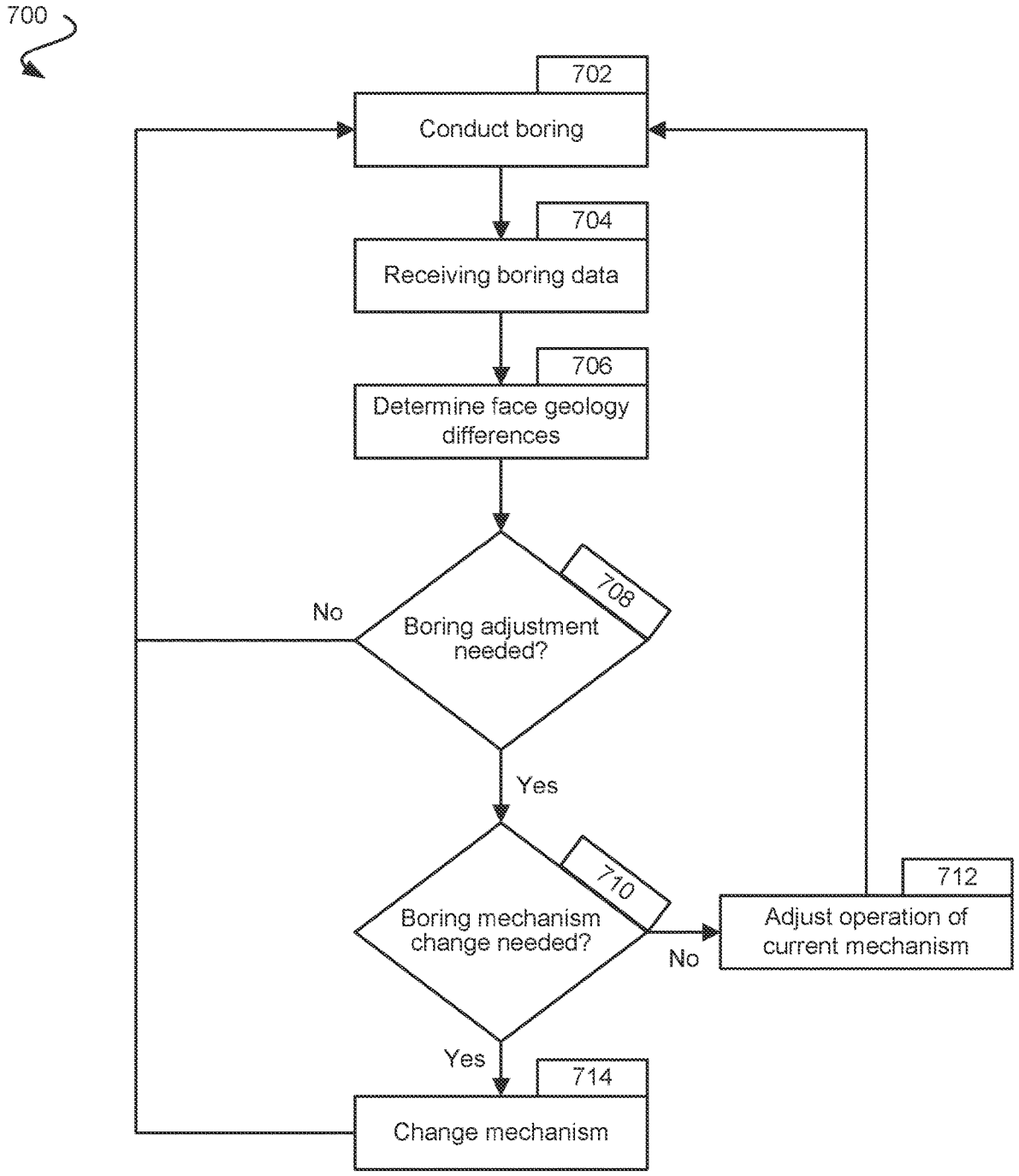
FIG. 7 is a flowchart detailing an example of a multi-head boring technique, in accordance with certain embodiments.

FIG. 7 is a flowchart detailing an example of a multi-head boring technique, in accordance with certain embodiments. FIG. 7 illustrates technique 700 that details a technique of changing or adjusting the boring mechanism and/or boring technique based on conditions downhole.

In 702, boring may be performed according to the techniques described herein. Such boring may be performed by, for example, a contact or non-contact boring mechanism, as described herein. During boring, data from sensors 118 may be received, in 704. Sensors 118 may include various sensors described herein and may allow for the determination of certain characteristics of boring (e.g., that of the condition of bore face 150 and/or of the geological conditions associated with boring).

In certain embodiments, such data may generate a boring log. The boring log may include data sampled at various intervals (e.g., based on need, triggered, and/or for a preset interval) of the boring operation and may include some or all of the various data described herein. Sampling of data may be based on intervals of time and/or distance traveled within borehole 152 and may include data directed to the position, orientation, or distance traveled within borehole 152 of chassis 110. The boring log may additionally include data directed to data received (e.g., images), the determinations from such data (e.g., geological composition or any other conditions described herein, such as conditions determined from the various sensors described herein in, for example, various tables), boring operations performed, and/or the results of such operations (e.g., rate of advance, power consumed, and/or other results). The boring log may be provided to onsite facility 170, offsite controller 172, and/or other such onsite or offsite facilities or controllers through any data communication technique described herein. The boring log may then be used to improve boring operations, such as through its use as additional training data for a machine learning device.

Thus, the boring log may allow for a determination of the performance and accuracy of the initial forecast (described in FIG. 6), as well as the performance and accuracy of the determination of the geological aspects of boring based on the data from the sensors. Based on such determinations, adjustments in initial forecasts as well as in how geological aspects of borehole 152 and/or bore face 150 are determined from sensor data may be performed (e.g., for the machine learning device).

In certain embodiments, data received from the sensors may be fused into a geologic map of the geological formation that the boring is conducted within. Thus, one or more controllers described herein may include a three-dimensional modeling module that may be configured to assemble and orient the data received (e.g., a sequence of geologic images) with the known or estimated trajectory or location of chassis 110 while boring through borehole 152. Such data may be received and/or rendered at predetermined distances along the length of borehole 152, resulting in a sequence of geological image slices along the path of borehole 152.

In certain such embodiments, one or more controllers described herein may interpolate the geology of the spaces between the sequential data points (e.g., through a set of interpolation rules that estimate geological values or characteristics based upon the geological values or characteristics of neighboring data points). Such interpolations may be based on, for example, the geological composition expected from data received from the sensors and determined via machine learning and/or may be based on a standard geological model based upon expected geological characteristics of materials at certain depths and/or other characteristics of the geological formation (e.g., based upon general location such as a mountain, riverbed, beachside, or bedrock). Such a geology map may be utilized for other systems boring in the general vicinity of system 100 and/or for future forecasting.

Based on the determined condition of bore face 150 and/or the geological conditions associated with boring changes in geological conditions may be determined in 706. Changes in geological conditions may require changes in the boring mechanisms or changes in the operation thereof of the currently selected boring mechanism. Whether such changes are needed is determined in 708. Such determination may be, for example, based on the detected conditions and may be based on, for example, the chemistry, mineralogy, void space, bedding, foliation, schistosity, joint spacing, orientation, aperture, water content, and/or compressive strength of the currently determined geological conditions. In certain embodiments, one or another boring technique or operation of a certain boring mechanism may be preferred for the conditions determined in 706. Such preferred mechanisms or operation thereof may, accordingly, be selected in 708 and, thus, a determination may be made as to whether adjustments are needed.

If no adjustments are determined to be needed, the technique may return to 702 and boring operations may continue. If adjustments are determined to be needed, the technique may proceed to 710. In 710, a determination is made as to whether boring operations should be utilized the current boring mechanism (e.g., continue using the boring element utilized for conducting boring in 702) or whether the boring mechanism should be changed (e.g., a non-contact boring element changed for a contact boring element, or vice versa) or another boring mechanism be concurrently operated (e.g., a non-contact boring element operated concurrently with a contact boring element and/or another non-contact boring element) to improve boring performance. In various embodiments, the boring mechanism may be a contact boring mechanism or a non-contact boring mechanism. Additionally or alternatively, a determination may be made, in 710, as to the changes in operation of the selected boring mechanism.

If no boring mechanism change is needed, operation of the boring mechanism may be adjusted in 712. Such adjustments may include, for example, changing the torque, rpm, power output, stand-off distance, and/or other aspects of operation of the selected boring mechanism. Thus, for example, various aspects may be adjusted in real time or near real time, such as, for non-contact boring element 114, dwell time on one or more features of bore face 150, stand-off distance 260, a raster rate of non-contact boring element 114, a raster pattern of non-contact boring element 114, or air pressure/flux at bore face 150.

In certain embodiments, the adjustment may be applied to boring across the entirety of bore face 150 or may be applied to various regions of bore face 150. For example, if bore face 150 transitions from one type of geology to another, the adjustment may apply to the entirety of bore face 150. However, if bore face 150 includes changes in only localized portions thereof, the adjustments may only apply to the localized portions. Thus, for example, a map of bore face 150 (known as a "bore face map") may be generated based on the techniques described herein. The bore face map may indicate various regions of bore face 150 and may indicate, for example, non-uniform features or aspects of bore face 150 that are geologically distinct from the rest of bore face 150 (e.g., a rock or vein having distinct mineral characteristics from the surrounding geology). Based on such determinations, operation of non-contact boring element 114 may be selectively adjusted when boring such regions.

For example, if an area of compressed sand or silt located between two segments of granite is detected at bore face 150, system 100 may selectively alter the temperature, pressure, stand-off distance, and dwell time, in coordination with the raster pattern, of non-contact boring element 114 to optimize boring efficiency. Accordingly, non-contact boring element 114 may apply higher temperatures and longer dwell times at the granite segments of bore face 150 and lower temperatures, shorter dwell times, and higher pressures at the sand portions of bore face 150.

If the boring mechanism should be changed and/or another boring mechanism should be additionally or alternatively utilized, the technique may proceed to 714. In 714, the additional boring mechanism may be utilized according to the techniques described herein. The technique may then return to 702 and boring operations may continue to be conducted.

Geological Boring Scenario Examples

The systems and techniques described herein allow for the selection of different non-contact and contact boring techniques based on geological conditions. In various scenarios, different geological conditions may require different applications of non-contact and/or contact boring. For example, data from various sensors may be used to determine current downhole geological conditions. Examples of sensor readings, the indications of geological conditions from the sensor readings, and the boring techniques for responding to such geological conditions are described herein:

Example 1—Limestone/Dolostone

Limestone is a hard rock composed almost entirely of $CaCO_3$ (calcite). Limestone may not be optimal for boring via certain non-contact techniques. Dolostone is similar in appearance to limestone and composed of a mix of $CaCO_3$ and $MgCO_3$ (dolomite). Though limestone and dolostone are visually similar, in various situations, non-contact or contact boring techniques may be preferable for various formations made of limestone, dolostone, or a combination thereof. Furthermore, it is appreciated that, such preferences may also be present in examples of various other visually similar geologic materials.

Limestone and dolostone may be determined based on survey and analysis techniques. However, in certain situations, a region may include both limestone and dolostone. Thus, bore head 200 may first bore in a solid dolostone formation. While boring, if a determination is made that (e.g., based on a spoil excavation rate change) the formation has changed to limestone, the boring technique utilized may be changed (e.g., non-contact boring may cease and contact boring may be used, or vice versa). In certain embodiments, confirmation of limestone may be obtained before, during, or after switching boring techniques. Thus, for example, an optical camera (with or without additional illumination) may be used to observe bore face 150 to determine visual indication of chemical change of limestone from the boring technique utilized (e.g., based on residue created from chemical reactions with limestone and/or dolostone from the boring technique).

In certain embodiments, based on the detection of limestone within the geological formation, the boring technique may be changed or parameters of the previously selected boring technique may be varied. In certain embodiments, spoil monitoring during boring may continue (e.g., with hyperspectral imaging of the spoil) to determine whether the spoil is of limestone or dolostone composition. Once the geological formation is detected to be dolostone again, the boring technique selected may be reverted for faster penetration rate and greater efficiency.

Example 2—Vesicular Basalt

Vesicularity is the presence of bubbles of air in otherwise solid, hard igneous rock. Vesicularity is common in basalt. Higher vesicularity geological formations may produce spoil of varying sizes at irregular intervals. In various situations, certain types of non-contact or contact boring techniques may be preferable for various levels of vesicularlity within geological formations.

When boring in low-vesicularity basalt formation, a change in the size of spoil and in temporal variability of spoil flux may be detected. Such a change may indicate that the vesicularity of the geological formation may have increased. In such a situation, boring may be periodically paused to determine whether there are signs of ineffective boring or insufficient excavation, through, for example, use of an optical camera or use of one or more thermocouples. If such conditions are detected, or if there is a lasting decrease in spoil excavation rate, the selected boring technique may be changed (e.g., a contact boring technique may be changed to a non-contact boring technique or a non-contact boring technique may be changed to a contact boring technique).

Spoil may be monitored, either manually or through imaging, at any point of spoil movement (e.g., at bore face 150 and/or along the exit route) and, once the vesicularity is observed to decrease appreciably, the previously selected boring technique may be resumed. Similarly, a geological formation may be predicted to have high vesicularity and, based on such predictions, the appropriate technique may be utilized.

Example 3—Mixed Face Conditions

Mixed face conditions may include conditions where hard rock interfaces with unconsolidated material such as sand and soil. Different drilling techniques may be preferred for the different components of a mixed face condition. In certain embodiments, optical imaging may be utilized to determine the location of various different geological materials on bore face 150 of a mixed face bore face. In certain such embodiments, non-contact boring element 114 may then be focused on the consolidated portions of bore face 150. In certain situations, after boring of the consolidated portions with non-contact boring element 114, the unconsolidated material may break on its own volition while in other situations, contact boring element 214 (e.g., including pipe jacking) may then be utilized as needed to bore the unconsolidated portions.

Figure 14:
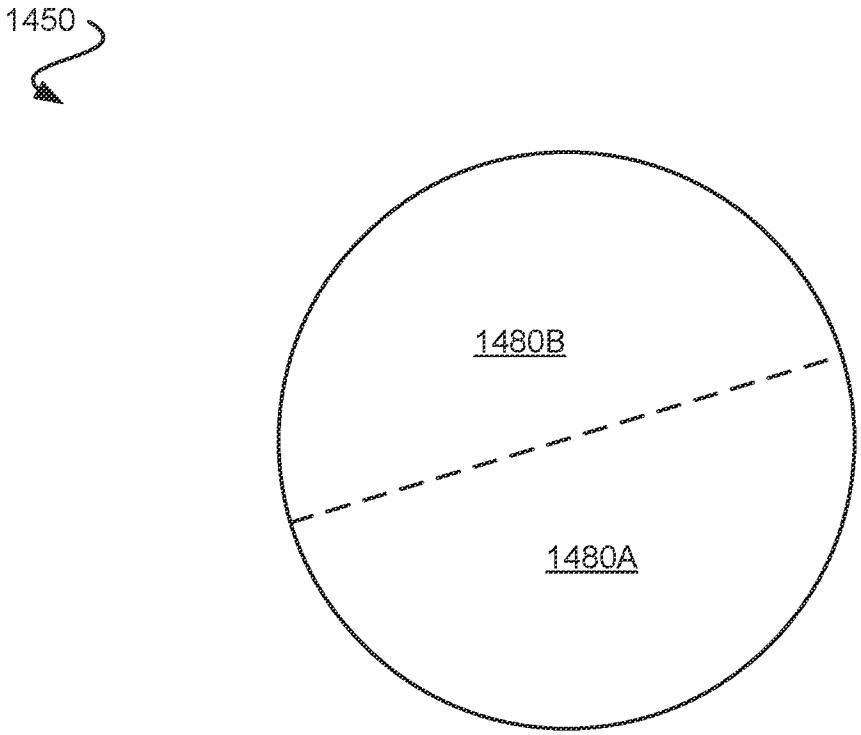
FIG. 14 illustrates an example of mixed face conditions, in accordance with certain embodiments.

Mixed face conditions may be further illustrated in FIG. 14. FIG. 14 illustrates an example of mixed face conditions, in accordance with certain embodiments. Bore face 1450 of FIG. 14 includes geological regions 1480A and 1480B.

1480A may be suited for non-contact boring techniques, while 1480B may not be suitable for such techniques. In certain examples, non-contact boring techniques may be utilized and may be concentrated on region 1480A of bore face 1450. Region 1480B may then either break apart from the non-contact boring of region 1480A or may be bored via contact boring.

Various embodiments may, for example, identify region 1480A and 1480B with imaging by cameras described herein (e.g., by obtaining an image of bore face 1450, either while boring is paused or during boring, and analyzing the electromagnetic wavelengths given by the various portions of bore face 1450 to generate a bore face geology), mineralogy analysis (e.g., through samples from various portions of bore face 1450), and/or through other techniques. Thus, for example, non-contact boring of bore face 1450 may direct heat (e.g., a thermal load) towards bore face 1450 to generate spallation. The heat may excite the molecules and atoms of the material within bore face 1450. The materials may then release electromagnetic radiation along known spectra. One or more cameras or other detectors may sense such electromagnetic radiation and analyze the frequency and/or amplitude to determine a chemical makeup of the bore face geology or portions thereof. In certain embodiments, a bore face map of bore face 1450 may be generated, indicating the geology of various portions of bore face 1450.

In certain embodiments, the bore face map may include a coordinate system and/or other representation of bore face 1450. Such a representation may match the physical locations on bore face 1450 to allow for determination of the longitudinal and latitudinal positions of the features to inform the operational parameters of the boring element used, such as the pitch, yaw, and stand-off distance.

Example 4—Pockets of Decomposed Rock

Decomposed rock may include unconsolidated or near-unconsolidated material. Such material may be easily broken apart by hand. An area of fault gorge may be a specific occurrence of weak, broken-up rock along fault zones.

Pockets of weathered, unconsolidated rock or sand may be present during boring. Such pockets may exist in otherwise hard rock formations that may be suitable for non-contact boring techniques. During such non-contact boring, material that does not spall well may be encountered and the shape of spoil may be observed (e.g., visually via camera) to change. In certain examples, non-contact boring (e.g., via thermal spallation) may result in consistent spoil of a certain shape. If spoil of another shape is observed and/or spoil flux is observed to slow, a determination may be made that a zone of weathered or otherwise unconsolidated rock has been encountered and contact drilling techniques may accordingly be utilized instead.

Example 5—Ground Water Inflow

Ground water concentration may vary significantly between different geological formations. For example, while hard rock may be mostly dry, certain formations, such as Karst formations, which is a type of limestone or dolostone formation, may include significant flowing ground water and void space.

In certain situations during non-contact boring, flowing ground water may be encountered. The ground water may flow into borehole 152 and may pool within borehole 152 and pool. Thermocouples may detect asymmetric cooling of borehole 152. For example, a thermocouple towards the bottom of chassis 110 may detect a larger change in temperature than a thermocouple at the top of chassis 110, indicating pooling ground water. Detection of the presence of such ground water may result in contact boring techniques being selected.

Example 6—Change in Rock Type

In certain embodiments, a hyperspectral camera may be utilized to deduce the composition of rock encountered during boring. The hyperspectral camera data may be used to infer the geological composition and, accordingly, the appropriate boring technique may be selected (e.g., non-contact boring techniques may be used for dolomite and contact boring techniques may be used for limestone).

Example 7—Jointed Rock

Jointed rock may be rock that is being broken by fractures which tend to occur systematically at regular intervals and at consistent angles. Joints may have zero or nonzero aperture, defined as the width of void space between successive blocks. Joints may be filled with precipitated minerals, such as calcite or quartz, or may flow water. Jointed formations may be detected based on surveys and/or through camera imaging. When jointed geological formations are detected, the rate of advance of bore head 200 may be via very small and short intervals or very slowly and continuously, to reduce the risk of collapse.

Certain jointed formations may include apertures (e.g., the distance between two faces of a joint) of non-zero distance. If an aperture greater than a threshold distance (e.g., above 0.5 inches) is detected, the orientation of non-contact boring element 114 may be utilized to bore across the section or contact boring techniques may be utilized. Detection of such an aperture may be due to a pronounced slowdown or cessation of spoil flux. A camera may, additionally or alternatively, be used to assess bore face 150 to determine if any aperture or hole is present within bore face 150.

Example 8—Gneiss

Gneiss is a metamorphic rock of variable chemistry with characteristic foliation planes. Foliation planes may be planes of altering chemistry in a rock with locally-consistent orientation, identifiable by their striped appearance. In certain embodiments, non-contact boring may be performed orthogonal to foliation planes. When boring in such a manner, a region where orientation changes gradually may be reached, which may result in the non-contact boring being parallel to or at an oblique angle to the planes. Such a situation may be determined based on a decrease in spoil flux, a change in spoil shape, or a change in orientation of foliation planes relative to spoil disc orientation (e.g., large axes of spoil discs will be striped while boring parallel to foliation planes, but solid in color while orthogonal). Traditional or hyperspectral imaging may detect such changes.

Example 9—Schist

Schist is a metamorphic rock of a variable chemistry exhibiting schistosity. Schistosity may be a structural feature of a rock where thin successive layers are intensely sheared such that their orientation varies over inches or less. Non-contact boring of schist may be performed orthogonal to the tangent plane of schistosity. As the tangent plane to foliation within schist may change frequently on short spatial scales, the articulation pattern of the non-contact boring element 114 may be changed based on imaging of bore face 150 or as a response to changes in spoil flux.

Example 10—Methane Pocket

Methane may seep into tunnels or bores over time. While non-contact boring techniques may burn off methane, sensors 118 may monitor methane levels to prevent explosion.

Example 11—Distinguishing Rock Types

Chemical and structural metrics may be measured through hyperspectral imaging, spectrometry, and/or other techniques to differentiate rock types. Hyperspectral imaging may measure the distinction between materials at bore face 150, through spoil exiting the tunnel, or in a region in between. In certain embodiments, the minerals of interest may be identified beforehand and sensors 118 may be configured to detect such minerals of interest. Furthermore, the structure of rock may also be measured (e.g., by cameras). Grain size and vesicularity may be determined, according to the techniques described herein, and such considerations may result in certain boring techniques being selected. In certain embodiments, machine learning techniques may be utilized to determine the mineral and structure of various rocks based on images obtained of bore face 150 and/or spoil.

Computing System Examples

Figure 8:
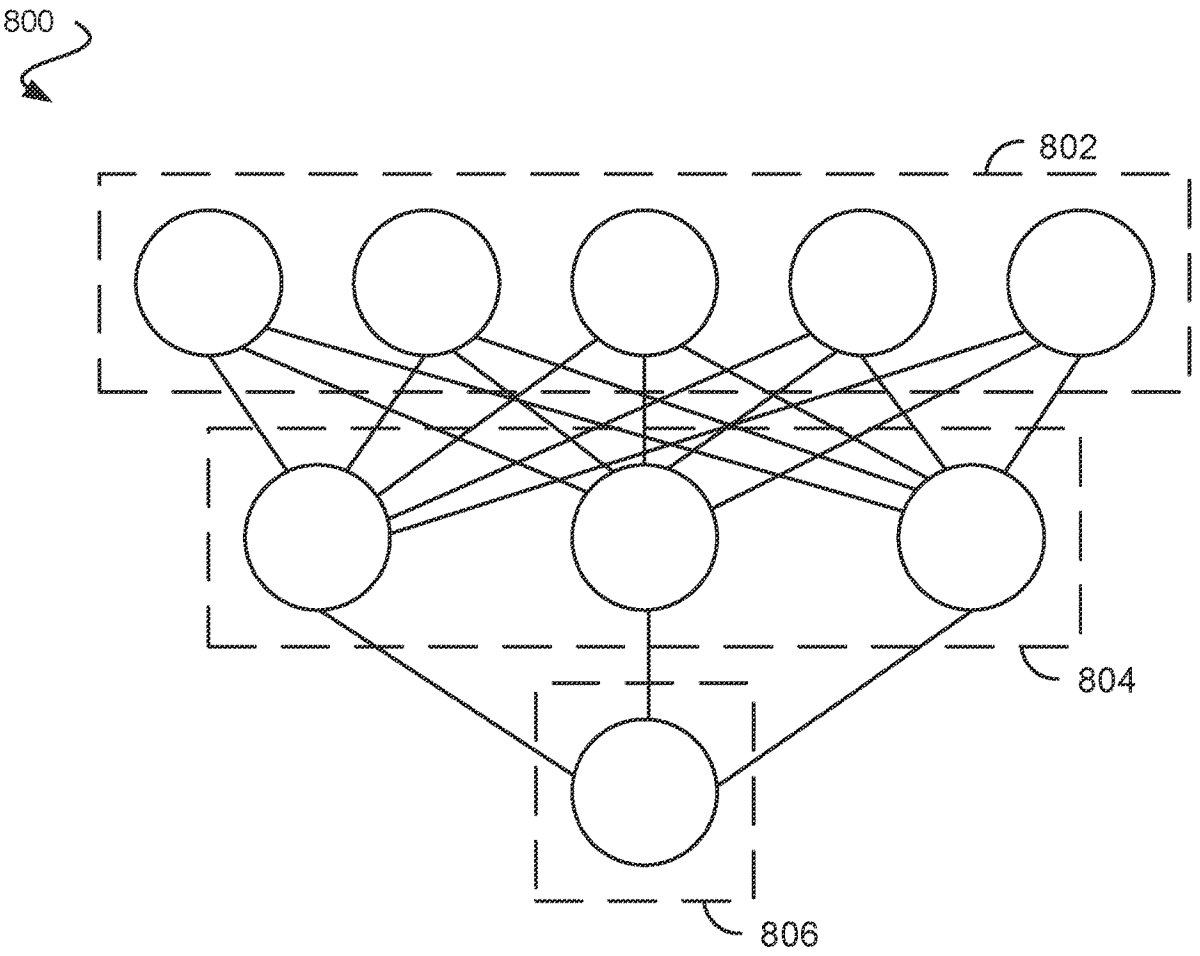
FIG. 8 illustrates an example neural network for machine learning, in accordance with certain embodiments.

FIG. 8 illustrates an example neural network for machine learning, in accordance with certain embodiments. FIG. 8 illustrates a neural network 800 that includes input layer 802, hidden layers 804, and output layer 806. Neural network 800 may be a machine learning network that may be trained to perform the techniques described herein.

Neural network 800 may be trained with inputs. Input layer 802 may include such inputs. Such inputs may include, for example, transaction data, physical actions requested, social contacts of the user, location data of the user, groups associated with the user, and/or other such data described herein. Hidden layers 804 may be one or more intermediate layers where logic is performed to determine various aspects of the data. Output layer 806 may result from computation performed within hidden layers 804 and may output, for example, predetermined boring instructions.

Machine learning may be utilized to determine parameters (e.g., survey results) of the techniques described herein and/or to perform the techniques themselves. In various embodiments, machine learning may continuously or periodically refine the determinations based on data received.

Figure 9:
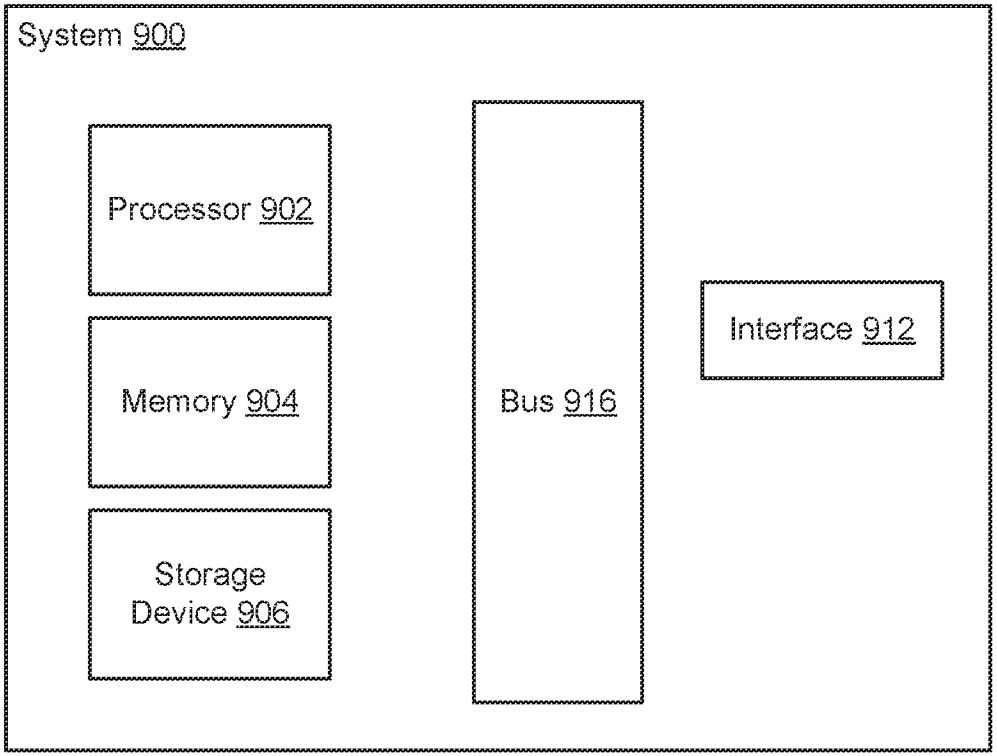
FIG. 9 illustrates a block diagram of an example computing system, in accordance with certain embodiments.

FIG. 9 illustrates a block diagram of an example computing system, in accordance with certain embodiments. According to various embodiments, a system 900 suitable for implementing embodiments described herein includes a processor 902, a memory module 904, a storage device 906, an interface 912, and a bus 916 (e.g., a PCI bus or other interconnection fabric.) System 900 may operate as a variety of devices such as a server system such as an application server and a database server, a client system such as a laptop, desktop, smartphone, tablet, wearable device, set top box, etc., or any other device or service described herein.

Although a particular configuration is described, a variety of alternative configurations are possible. The processor 902 may perform operations such as those described herein. Instructions for performing such operations may be embodied in the memory 904, on one or more non-transitory computer readable media, or on some other storage device. Various specially configured devices can also be used in place of or in addition to the processor 902. The interface 912 may be configured to send and receive data packets over a network. Examples of supported interfaces include, but are not limited to: Ethernet, fast Ethernet, Gigabit Ethernet, frame relay, cable, digital subscriber line (DSL), token ring, Asynchronous Transfer Mode (ATM), High-Speed Serial Interface (HSSI), and Fiber Distributed Data Interface (FDDI). These interfaces may include ports appropriate for communication with the appropriate media. They may also include an independent processor and/or volatile RAM. A computer system or computing device may include or communicate with a monitor, printer, or other suitable display for providing any of the results mentioned herein to a user.

CONCLUSION

Although the foregoing concepts have been described in some detail for purposes of clarity of understanding, it will be apparent that certain changes and modifications may be practiced within the scope of the appended claims. It should be noted that there are many alternative ways of implementing the processes, systems, and apparatuses. Accordingly, the present embodiments are to be considered illustrative and not restrictive.

What is claimed is:

1. A system comprising:

a bore head comprising a non-contact boring mechanism, the non-contact boring mechanism comprising a jet engine;

a first sensor, configured to measure a first boring parameter associated with boring operations of the non-contact boring mechanism; and a controller, communicatively coupled to the first sensor and configured to:

cause the jet engine to operate in a borehole in a first manner by directing exhaust gases of the jet engine to a geological formation to perform thermal spallation;

receive first data from the first sensor;

determine the first boring parameter from the first data; and cause, based on the determined first boring parameter, the non-contact boring mechanism to operate in a second manner, wherein the operating in the second manner comprises adjusting at least one of:

a dwell time of the jet engine on features of the geological formation;

stand-off distance of the jet engine from a bore face of the geological formation;

a raster rate of the jet engine; and a raster pattern of the jet engine.

2. The system of claim 1, wherein the first sensor comprises a thermal sensor configured to determine a first temperature associated with boring.

3. The system of claim 2, wherein the first boring parameter comprises a change in geology based on determining a temperature change from the data of the first sensor.

4. The system of claim 3, wherein the bore head further comprises a contact boring mechanism.

5. The system of claim 4, wherein the causing the non-contact boring mechanism to operate in the second manner comprises ceasing the boring operations with the non-contact boring mechanism, and wherein the operations further comprise:

causing, based on the determined first boring parameter, the contact boring mechanism to commence boring operations.

6. The system of claim 5, wherein the first boring parameter is a spoil excavation rate.

7. The system of claim 5, wherein the first sensor comprises a plurality of thermocouples, wherein the first data comprises borehole temperature data associated with each of the plurality of thermocouples, and wherein the first boring parameter is a difference in cooling rates between the plurality of thermocouples.

8. The system of claim 5, wherein the first sensor comprises a visual camera, wherein the first data comprises visual data of spoil from operation of the jet engine, and wherein the first boring parameter comprises determining, from a change in spoil shape from the visual data, that the jet engine is operating in an unconsolidated region of the borehole.

9. The system of claim 1, wherein the first sensor is configured to measure the first parameter proximate to a bore face.

10. The system of claim 9, wherein the bore head further comprises a contact boring mechanism, wherein the causing the non-contact boring mechanism to operate in the second manner comprises causing, based on the determined first boring parameter, the non-contact boring mechanism to bore a first portion of the bore face, and wherein the controller is further configured to:

cause, based on the determined first boring parameter, the contact boring mechanism to bore a second portion of the bore face.

11. The system of claim 9, further comprising:

a second sensor, configured to measure a second parameter away from the bore face, wherein the operations further comprise:

receiving second data from the second sensor, wherein the first boring parameter is determined based further on the second sensor.

12. The system of claim 1, wherein the bore head further comprises a contact boring mechanism, and wherein the controller is further configured to:

switch the boring operations from the non-contact boring mechanism to the contact boring mechanism; and cause the contact boring mechanism to operate in a third manner.

13. The system of claim 1, wherein the bore head comprises a first portion of the bore head with the non-contact boring mechanism and a second portion of the bore head with a contact boring mechanism, and wherein the controller is further configured to:

switch the first portion of the bore head with the second portion of the bore head; and cause the contact boring mechanism to operate in a third manner.

14. The system of claim 1, wherein the first sensor comprises one or more of a temperature sensor, a speed/torque sensor, a pressure sensor, a power output sensor, a flow rate sensor, a conductivity sensor, a gas flow meter, an altimeter, a potentiometer, and/or a clearance sensor.

15. The system of claim 1, wherein the non-contact boring mechanism further comprises one or more of, a plasma torch, an oxy-fuel torch, and/or a thermal, light, or radiation emitting element.

16. The system of claim 1, wherein the first boring parameter comprises a boring path direction change, and wherein the second manner comprises operating the non-contact boring mechanism to effect the boring path direction change.

17. The system of claim 1, further comprising:

a chassis, wherein the bore head, the first sensor, and the controller are coupled to the chassis, and wherein the chassis is configured to propel the bore head, the first sensor, and the controller, wherein the determining the first boring parameter comprises:

determining a bore face map associated with the borehole; and determining a first region and a second region within the bore face map corresponding to respective regions of a bore face of the borehole, wherein the jet engine operates in the first manner for the first region and operates in the second manner for the second region.

18. The system of claim 17, wherein the first region and the second region are geologically distinct.

* * * * *